United States Patent [19]

Kaneko

[11] Patent Number: 4,881,730

[45] Date of Patent: Nov. 21, 1989

[54] SORTER

[75] Inventor: Tamaki Kaneko, Fujisawa, Japan

[73] Assignee: O/A Technologies, Inc., Irvine, Calif.

[21] Appl. No.: 159,497

[22] Filed: Feb. 16, 1988

Related U.S. Application Data

[63] Continuation of Ser. No. 3,146, Jan. 14, 1987, abandoned.

[30] Foreign Application Priority Data

| | | | |
|---|---|---|---|
| Jan. 20, 1986 | [JP] | Japan | 61-008007 |
| Jan. 21, 1986 | [JP] | Japan | 61-008981 |
| Oct. 20, 1986 | [JP] | Japan | 61-247457 |

[51] Int. Cl.[4] ..... B65H 3/10

[52] U.S. Cl. ..... 271/296; 271/298; 271/302; 271/303

[58] Field of Search ..... 271/290, 296, 298, 302, 271/303

[56] References Cited

U.S. PATENT DOCUMENTS

| | | | |
|---|---|---|---|
| 4,012,032 | 3/1977 | Rogers | 271/290 |
| 4,123,155 | 10/1978 | Hubert | 271/296 |
| 4,322,069 | 3/1982 | Mitchell | 271/296 |
| 4,330,200 | 5/1982 | Kikuchi et al. | 271/296 |
| 4,344,614 | 8/1982 | Kaneko et al. | 271/296 |
| 4,678,180 | 7/1987 | Tamura et al. | 271/296 |
| 4,688,786 | 8/1987 | Takahata | 271/296 |
| 4,709,915 | 12/1987 | Ishikawa et al. | 271/296 |
| 4,750,731 | 6/1988 | Oei et al. | 271/290 |

FOREIGN PATENT DOCUMENTS

| | | | |
|---|---|---|---|
| 288881 | 11/1988 | European Pat. Off. | 271/296 |
| 2195320 | 4/1988 | United Kingdom | 271/296 |

*Primary Examiner*—Joseph J. Rolla
*Assistant Examiner*—Steven M. Reiss
*Attorney, Agent, or Firm*—Oblon, Spivak, McClelland, Maier & Neustadt

[57] ABSTRACT

A sorter sorting a plurality of sheets one by one onto a plurality of receptacles disposed vertically. In the sorter, a minimum of two sheet dividers is provided in front of these receptacles to sort sheets by independently raising or lowering these sheet dividers.

12 Claims, 22 Drawing Sheets

SORTER

This application is a continuation of application Ser. No. 003,146 filed on Jan. 14, 1987, now abandoned.

FIELD OF THE INVENTION

This invention relates to a sorter which is attached to a sheet handling machine working on sheet material, such as an electronic copying machine, facsimile, printer, etc., to sort a plurality of sheets discharged one by one from the sheet handling machine.

RELATED ART STATEMENT

Heretofore there has been known a sorter which consists of a plurality of receptacles vertically disposed at given intervals, a recorded paper carrier having a belt disposed close to the receptacles to carry sheet material such as recorded sheets of paper upwards or downwards and a suction fan drawing the recorded sheets into the belt, a lift member disposed and vertically movable between the recorded paper carrier and the receptacles, a direction changer disposed at the lift member to direct to a desired receptacle a traveling direction of recorded sheets of paper being transferred by the recorded paper carrier, and a pair of paper discharge rollers disposed at the lift member to discharge, on a desired receptacle, recorded sheets whose direction was changed by the direction changer.

The aforesaid sorter, however, must start operation from a position corresponding to the highest receptacle or the lowest to carry recorded sheets discharged from a sheet handling machine such as an electronic copying machine to a desired receptacle by a recorded sheet carrier, so that movements of recorded sheets for sorting become extremely large, thus resulting in a disadvantage of a slow sort operation of recorded sheets.

OBJECT AND SUMMARY OF THE INVENTION

In view of the above, it is the object and purpose of the invention to provide a sorter which can sort a plurality of sheets at high speed.

In a sorter according to the first invention, which has a plurality of receptacles vertically disposed at given intervals to sort sheets discharged from a sheet handling machine onto a plurality of these receptacles, the aforesaid object can be accomplished by providing two lift members disposed close to the aforesaid receptacles and movable up and down, lift drivers respectively raising and lowering these respective lift members, sheet pinchers respectively disposed at the aforesaid respective lift members to momentarily hold a sheet being transferred, sheet discharge means respectively disposed at the aforesaid respective lift members to discharge sheets onto receptacles, and by pinching sheets discharged from the aforesaid sheet handling machine using the sheet pincher for a lift member selected from the aforesaid two lift members, moving the aforesaid selected lift member to a target position while pinching a sheet sent and then by discharging the sheet onto receptacles using the aforesaid sheet discharge means.

In a sorter according to the second invention, which has a plurality of receptacles vertically disposed at given intervals and sorts sheets discharged from a sheet handling machine onto a plurality of these receptacles, the aforesaid object can be accomplished by providing two lift members disposed close to those receptacles and movable up and down, lift drivers respectively raising and lowering these respective lift members, sheet pinchers respectively disposed at the aforesaid respective lift members to momentarily hold a sheet being transferred, sheet discharge means respectively disposed at the aforesaid respective lift members to discharge sheets onto receptacles, and a sheet guide to guide sheets discharged from the aforesaid sheet handling machine to a position matching a reference receptacle or one of a plurality of these receptacles, and by permitting one of the aforesaid two lift members to rise and lower in a range upwards of a home position matching the aforesaid reference receptacle, permitting the other lift member to rise and lower in a range downwards of the aforesaid home position, selecting one of these lift members as required to keep the selected lift member on standby at the aforesaid home position, pinching sheets sent through the aforesaid sheet guide using the sheet pincher, moving the aforesaid lift member to a target position while pinching sheets, and then by sorting sheets onto receptacles using the aforesaid sheet discharge means.

In a sorter according to the third invention, which has a plurality of receptacles vertically disposed at given intervals and sorts sheets discharged from a sheet handling machine onto a plurality of these receptacles, the aforesaid object can be accomplished by providing two lift members disposed close to these receptacles and movable up and down, lift drivers respectively raising and lowering these respective lift members, sheet pinchers respectively disposed at the aforesaid respective lift members to momentarily hold a sheet being transferred, sheet discharge means respectively disposed at the aforesaid respective lift members to discharge sheets onto receptacles, and sheet guide means to guide sheets discharged from the aforesaid sheet handling machine selectively to two reference receptacles or either two of a plurality of the aforesaid receptacles, and by keeping the aforesaid two respective lift members on standby at two home positions respectively matching the aforesaid two reference receptacles, selecting one of the two home position to guide sheets using the aforesaid sheet guide means, pinching a sheet sent using the sheet pincher for the lift member standing by at either selected home position, moving the aforesaid lift member to a target position while pinching the sheet, and then by sorting the sheet onto the target receptacle using the aforesaid sheet discharge means.

BRIEF DESCRIPTION OF THE DRAWINGS

In the accompanying drawings, there are shown illustrative embodiments of the invention from which these and other of its objectives, novel features and advantages will be readily apparent.

In the drawings.

DESCRIPTION OF THE PREFERRED EMBODIMENTS

Figure 1:
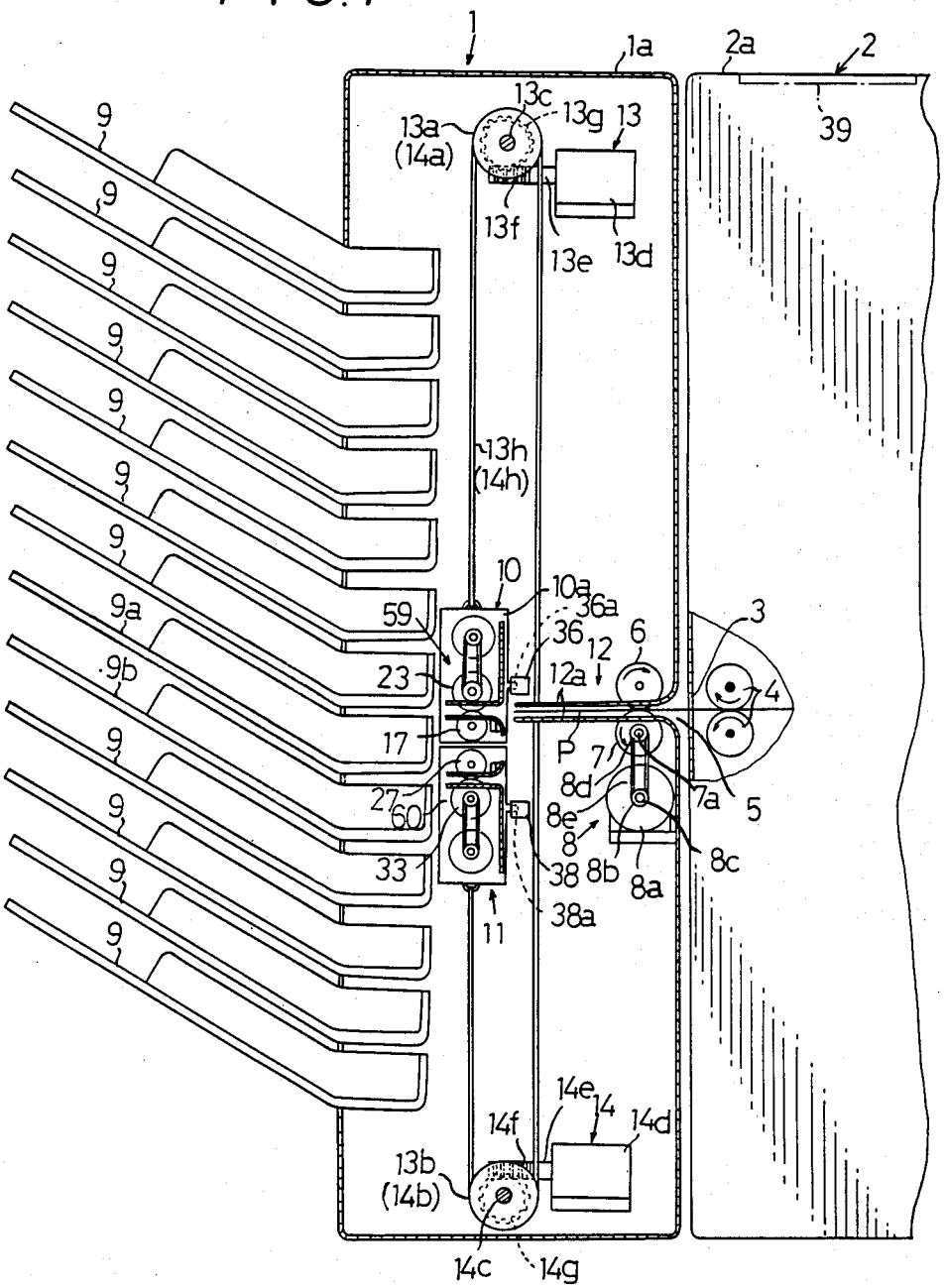
FIG. 1 is a side sectional view of a first embodiment according to the invention.
Figure 2:
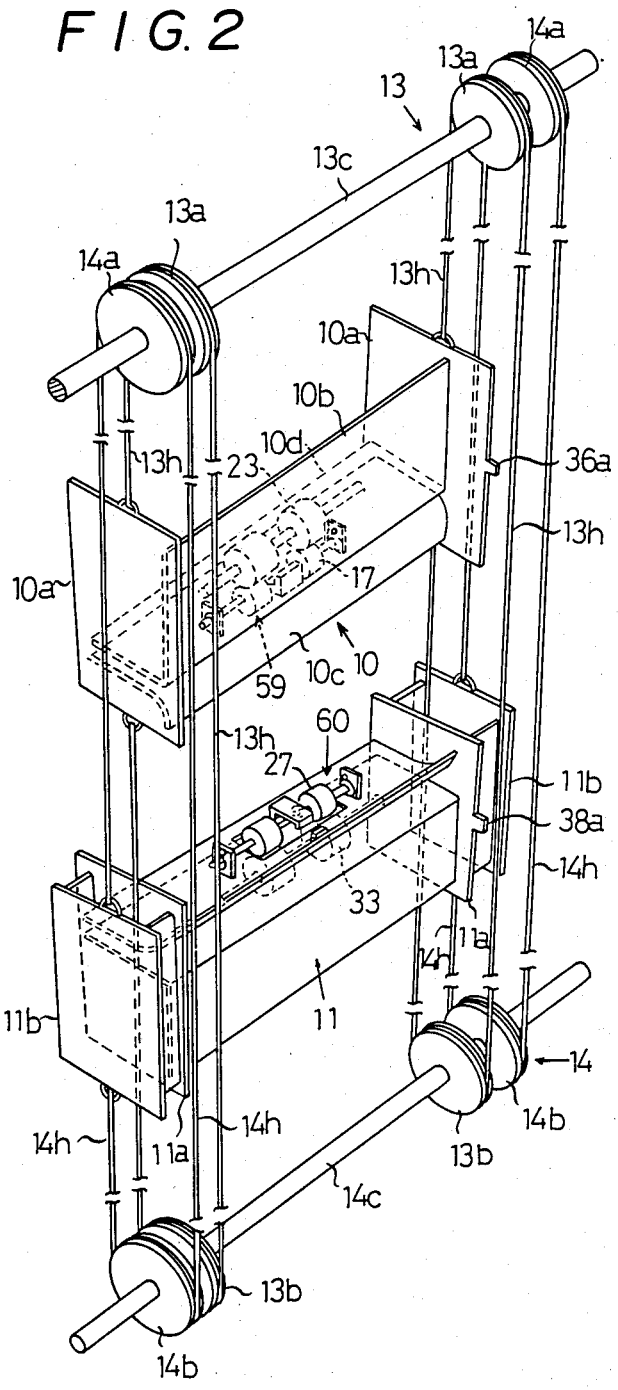
FIG. 2 is a perspective view of main parts of the 1st embodiment.

In FIG. 1, Numeral 1 is a sorter according to the 1st invention. A sheet handling machine such as an electronic copying machine 2 is disposed adjacent to a casing 1*a* of the sorter 1. A paper discharge port 3 is formed in a casing 2*a* of the electronic copying machine 2 to discharge sheets or recorded sheets of paper P toward the sorter 1. A pair of paper discharge rollers 4 is disposed inside the casing 2*a* near the paper discharge port 3.

In the casing 1*a* of the sorter 1, a paper receive port 5 is the electronic copying machine 2. A pair of receive rollers 6 and 7 is formed inside the casing 1*a* near a paper receive port 5. These receive rollers 6 and 7 are pressed down to each other, and one of the receive rollers 7 is rotated by a receive roller driver 8, which consists of a motor 8*a* fixed to the casing 1*a*, a pulley 8*c* fixed to a drive shaft 8*a* in the motor 8*a*, a pulley 8*d* fixed to a shaft 7*a* of the receive roller 7 and a belt 8*e* looped over these pulley 8*c* and 8*d*.

On a paper-feed direction side of the aforesaid receive rollers 6 and 7, a plurality of receptacles 9 are vertically disposed at given intervals. These receptacles 9 are supported by the casing 1*a*, and the best part of these receptacles 9 extends out of an opening of the casing 1*a*.

Between the aforesaid receive rollers 6 and 7 and the receptacles 9, lift members 10 and 11 are disposed next to the receptacles 9 and can be moved vertically. Between the aforesaid receive rollers 6 and 7 and the lift members 10 and 11, a paper guide (sheet guide) 12 is disposed to guide recorded sheets of paper P. The paper guide 12 consists of two guide members 12*a* which guide recorded sheets of paper P sent from the receive rollers 6 and 7 to a position matching a central reference receptacle 9*a* of the receptacles 9. The aforesaid lift members 10 and 11 are raised or lowered by lift drivers 13 and 14.

The lift driver 13 consists of two pairs of pulleys 13*a* and 13*b* disposed vertically apart opposite to each other, a reversible step motor 13*d* disposed close to a revolving shaft 13*c* of the upper pulleys 13*a*, a worm gear 13*f* fixed to a drive shaft 13*e* of the step motor 13*d*, a wheel gear 13*g* fixed to the revolving shaft 13*c* of the pulleys 13*a* to engage with the worm gear 13*f*, and a pair of wires 13*h* looped over the aforesaid pulleys 13*a* and 13*b* to which side plates 10*a* of the lift member 10 are fixed. The aforesaid pulleys 13*a* are fixed to the shaft 13*c* and the pulleys 13*b* rotatably supported with the shaft 14*c*. The aforesaid shafts 13*c* and 14*c* are supported with bearings fixed to the casing 1*a*. The aforesaid step motor 13*d* is also fixed to the casing 1*a*.

And, the lift driver 14 also consists of two pairs of pulleys 14*a* and 14*b* disposed vertically apart opposite to each other, a reversible step motor 14*d* disposed close to a revolving shaft 14*c* of the lower pulleys 14*b*, a worm gear 14*f* fixed to a drive shaft 14*e* of the step motor 14*d*, a wheel gear 14*g* fixed to the revolving shaft 14*c* of the pulleys 14*b* to engage with the worm gear 14*f*, and a pair of wires 14*h* looped over the aforesaid pulleys 14*b* to which the hold member 11*b* extending out of the side plates 11*a* of the lift member 11 are fixed. The aforesaid pulleys 14*b* are fixed to the shaft 14*c* and the pulleys 14*b* rotatably supported with the shaft 13*c*. The aforesaid step motor 14*d* is also fixed to the casing 1*a*.

The aforesaid lift member 10 consists of the side plates 10*a* and the hold plate 10*b* integrally fixed thereto. In the lift member 10, two guide members 10*c* and 10*d* are disposed to guide recorded sheets P being pushed out by the receive rollers 6 and 7.

Figure 4:
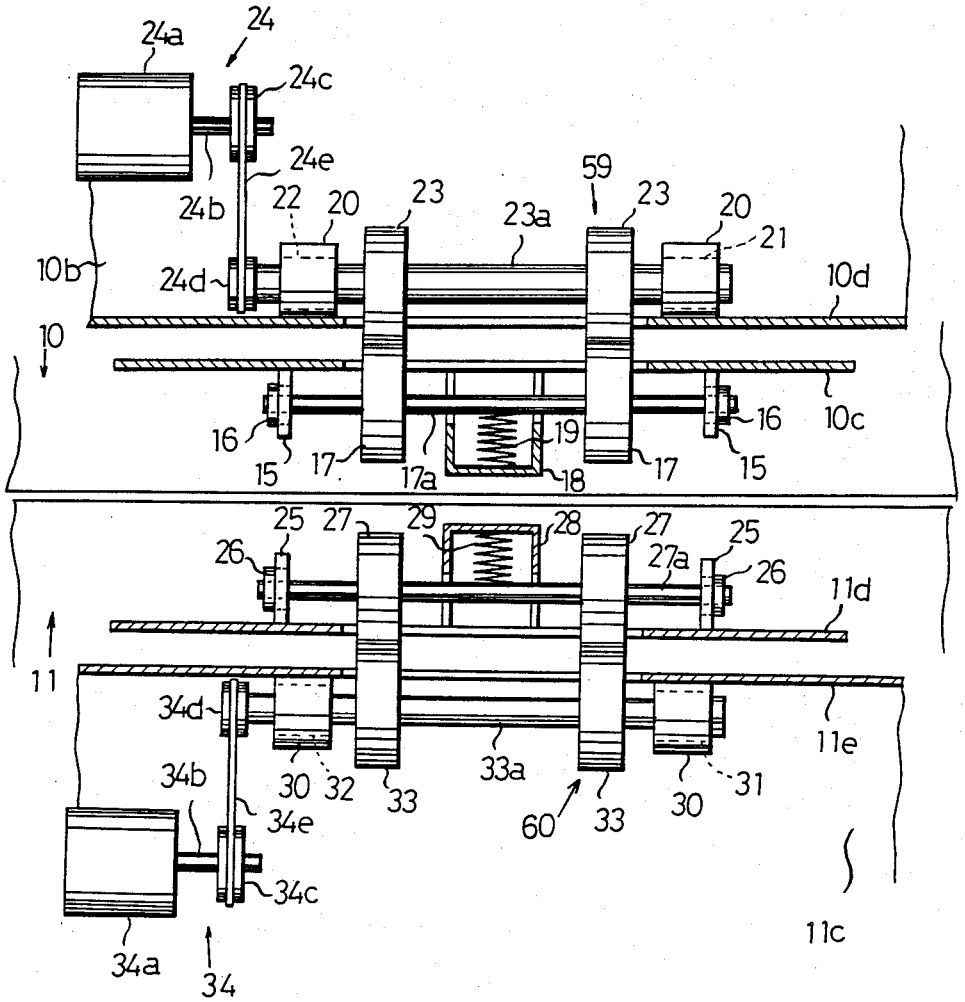
FIG. 4 is a front sectional view of the lift member, etc. shown in FIG. 3.

As shown in FIG. 4, from the guide member 10*c* extend out two support members 15, in which bearings 16 are disposed to slide vertically a little distance through slotted holes. And, a revolving shaft 17*a* for paper discharge rollers 17 is supported with these bearings 16. From the aforesaid guide member 10*c* projects out a hold member 18, which houses a spring 19 to press up the revolving shaft 17*a* for the paper discharge rollers 17.

From the aforesaid guide member 10*d* extend out two support members 20, that incorporate respectively a one-way clutch 21 and a bearing 22, by which is supported a shaft 23*a* for separate paper discharge rollers 23. The paper discharge rollers 23 are rotated by a paper discharge roller 24, which consists of a motor 24*a* fixed to the hold plate 10*b* in the lift member 10, a pulley 24*c* secured to a drive shaft 24*b* of the motor 24*a*, another pulley 24*d* fixed to the shaft 23*a* for the paper discharge rollers 23 and disposed opposite to the pulley 24*c*, and a belt 24*e* looped over those pulleys 24*c* and 24*d*. The aforesaid one-way clutch 21 permits the paper discharge rollers 23 to rotate in such a direction as to transfer recorded sheets P toward the receptacles 9, but does not permit the paper discharge rollers 23 to rotate adversely to the aforesaid direction.

The aforesaid lift member 11 consists of side plates 11*a* and a hold member 11*b* and a hold plate 11*c* integrally fixed thereto. In these both side plates 11*a* and the hold plate 11*c*, two guide members 11*d* and 11*e* are disposed to guide recorded sheets P being pushed out by the receive rollers 6 and 7.

As shown in FIG. 4, from the guide member 11*d* extend out two support members 25, in which bearings 26 are disposed to slide vertically a little distance through slotted holes. And, a shaft 27*a* for paper discharge rollers 27 is supported with these bearings 26. From the aforesaid guide member 11*d* projects out a hold member 28, which houses a spring 29 to press down the shaft 27*a* for the paper discharge rollers 27.

From the aforesaid guide member 11*e* also extend out two support members 30, that incorporate respectively a one-way clutch 31 and a bearing 32, by which is supported a shaft 33*a* for separate paper discharge rollers 33. The paper discharge rollers are rotated by a paper discharge roller driver 34, which consists of a motor 34*a* fixed to the hold plate 11*c* in the lift member 11, a pulley 34*c* secured to a drive shaft 34*b* of the motor 34*a*, another pulley 34*d* fixed to the shaft 33*a* for the paper discharge rollers 33 and disposed opposite to the pulley 34*c*, and a belt 34*e* looped over those pulleys 34*c* and 34*d*. The aforesaid one-way clutch 31 permits the paper discharge rollers 33 to rotate in such a direction as to transfer recorded sheets P toward the receptacles 9, but does not permit the paper discharge rollers 33 to rotate adversely to the aforesaid direction.

Figure 3:
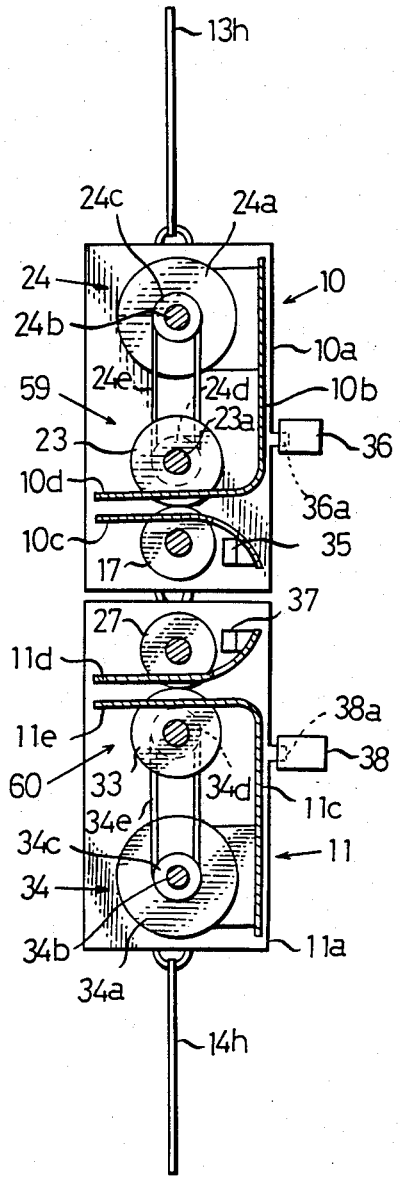
FIG. 3 is a enlarged sectional view of the lift member, etc. in the embodiment.

As shown in FIG. 3, near the aforesaid paper discharge rollers 17 and 23 between the paper discharge rollers 17 and 23 and the receive rollers 6 and 7, is disposed a paper sensor 35, which is of a photosensor type and is fixed to the guide member 10*c*. To detect that the aforesaid paper discharge rollers 17 and 23 have been deployed to a 1st home position matching a central reference receptacle 9*a* of the receptacles 9 where they receive recorded sheets of paper P sent from the receive rollers 6 and 7, at a given point is disposed a 1st roller home position sensor 36, which is, also of a photosensor type, to identify that the paper discharge rollers 17 and 23 have reached the 1st home position by detecting that the detect piece 36*a* projecting from the side plate 10*a* on the lift member 10 has reached a desired position.

And also, near the aforesaid paper discharge rollers 27 and 33 between the paper discharge rollers 27 and 33 and the receive rollers 6 and 7, is disposed a paper sensor 37, which is of a photosensor type and is fixed to the guide member 11*d*. To detect that the aforesaid paper discharge rollers 27 and 33 have been deployed to a 2nd home position matching a receptacle 9*b* just below the central reference receptacle 9*a* of the receptacles 9 where they receive recorded sheets of paper P sent from the receive rollers 6 and 7, at a given point is disposed a 2nd roller home position sensor 38, which is also of a photosensor type to identify that the paper discharge rollers 27 and 33 have reached the 2nd home position by detecting that the detect piece 38*a* projecting from the side plate 11*a* on the lift member 11 has reached a desired position.

When a recorded sheet P is sent in between the aforesaid receive rollers 6 and 7 from the paper discharge rollers 4 in the electronic copying machine, the receive rollers 6 and 7 transfer the recorded sheet P toward the paper discharge rollers 17 and 23 or 27 and 33. At the instant, the paper discharge rollers 17 and 23 or 27 and 33 stand by without rotation at a 1st home position to receive the recorded sheet P . When the aforesaid paper sensor 35 or 37 detects a leading edge of the recorded sheet P, the paper discharge rollers 17 and 23 or 27 and 33 rotate only for a short time enough to transfer the recorded sheet P toward the receptacle 9, until the paper discharge rollers 17 and 23 or 27 and 33 pinch the leading edge of the recorded sheet P. Then they come to a halt.

At the instant when the aforesaid paper discharge rollers 17 and 23 or 27 and 33 have succeeded in pinching the recorded sheet P, the lift member 10 or 11 and the paper discharge rollers 17 and 23 or 27 and 33 come to a stop at a position matching a target receptacle 9 after moving toward the receptacle 9. While the lift member 10 or 11 and the paper discharge rollers 17 and 23 or 27 and 33 are moving, since the one-way clutch 21 or 31 does not permit the paper discharge roller 23 or 33 to rotate in a direction adverse to such one as to send the recorded sheet P toward the receptacle 9, there is no chance that the recorded sheet P should get out of the paper discharge rollers 17 and 23 or 27 and 33. A motion speed of the paper discharge rollers 17 and 23 or 27 and 33 in moving toward a target receptacle 9 is set to a speed similar to a paper feed speed of the paper discharge rollers 4 in an electronic copying machine 2. Therefore, while the paper discharge rollers 17 and 23 or 27 and 33 are moving along, the similar speeds keep a recorded sheet P from getting out of the paper discharge rollers 17 and 23 or 27 and 33, by eliminating an undesirable resistance force acting on the recorded sheet P.

On having come to a position matching a target receptacle 9, the aforesaid paper discharge rollers 17 and 23 or 27 and 33 begin to rotate and discharge a recorded sheet P onto the receptacle 9, as well as stop rotation a certain short time after the paper sensor's 35 or 37 detection of a trailing edge of the recorded sheet P to return back the lift member 10 or 11 and the paper discharge rollers 17 and 23 or 27 and 33 to the 1st home position or the 2nd, when a return speed thereof can be larger than a feed speed of recorded sheet P by the paper discharge rollers 4 in an electronic copying machine 2, because at this time the paper discharge rollers 17 and 23 or 27 and 33 have nothing to do with pinching of sheets P.

Figure 5:
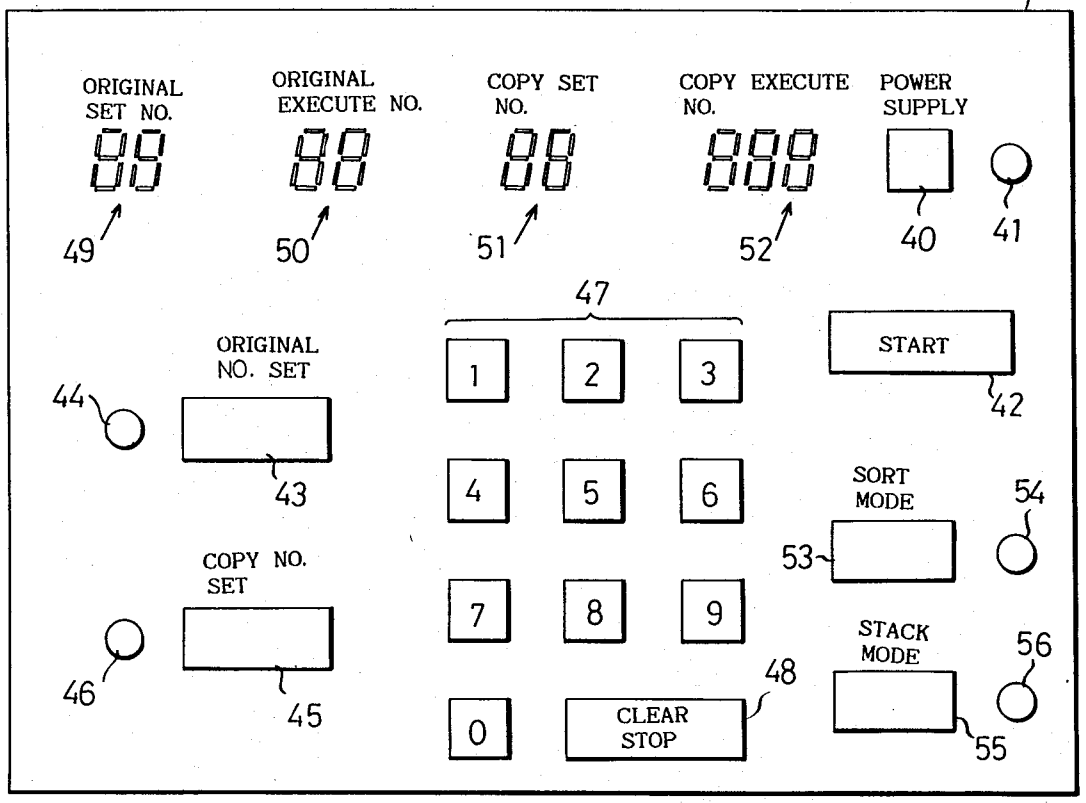
FIG. 5 is a plan view of an operation indicating panel.

FIG. 5 shows an operation indicating panel 39 disposed on an upper surface of the casing 2*a* covering the aforesaid electronic copying machine 2. The operation is as follows:

On the operation indicating panel 39 there are such a variety of functional parts as follows; a "power key" 40 turning power ON or OFF, "power indicator" 41 giving visual presentations of power ON or OFF, "START key" 42 initiating copying operation, "original No. set key" 43 for setting original No., "original No. set indicator" 44 showing the original No. set key 43 ON or NOT, "copy No. set key" 45 for setting copy No., "copy No. set indicator" 46 showing the copy No. set key 45 ON or NOT, a set of "ten keys" 47 for inputting original No. or copy No., "CLEAR STOP key" 48 for clearing inputted Nos. by the ten keys 47 and for stopping copying operation, "original set No. indicator" 49 showing the number of original sets, "original execute No. indicator" 50 showing the number of original sheets having been copied, "copy set No. indicator" 51 giving the number of sets to be copied, "copy execute No. indicator" 52 showing the number of copied sheets P, "sort mode key" 53 for setting sort mode, "sort mode indicator" 54 showing if sort mode has been set or not, "stack mode key" 55 for setting stack mode and "stack mode indicator" 56 showing if stack mode has been set or not.

When the ten keys 47 are typed after the aforesaid original No. set key 43 is turned ON, a number of originals to be copied is inputted, and when the ten keys 47 are keyed in after the aforesaid copy No. set key 45 is turned ON, a number of recording sets to be copied is inputted The aforesaid "sort mode" refers to a mode where every recorded sheet P is stacked in turn on every receptacle 9. And, the aforesaid "stack mode" refers to a mode where recorded sheets P are stacked, first, on a 1st receptacle to its full capacity, and, second, on a 2nd receptacle also to its full capacity, and so on in turn.

Figure 6:
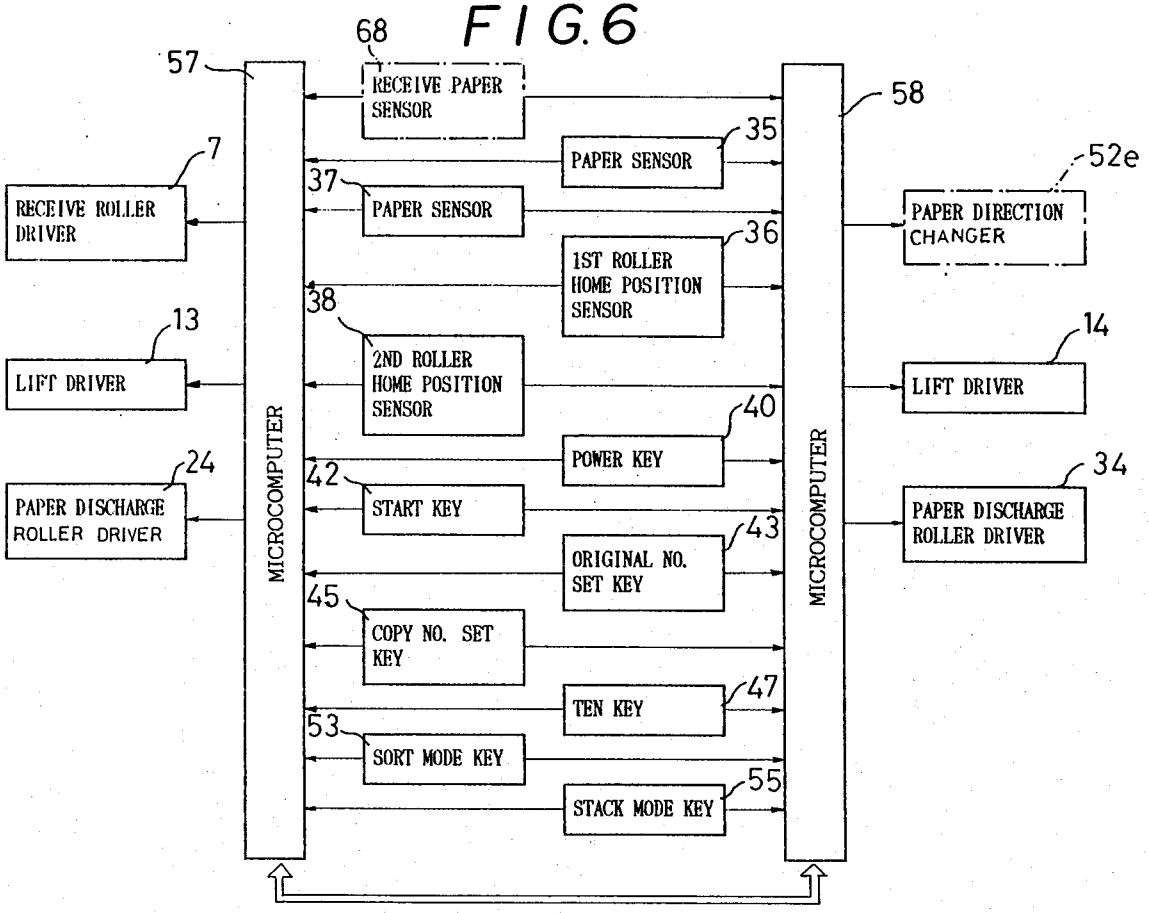
FIG. 6 is a functional block diagram of a control device of the first embodiment.

FIG. 6 shows a functional block diagram of a control device for the aforesaid sorter 1. The operation is as follows:

Information such as from the aforesaid paper sensors 35 and 37, the 1st roller home position sensor 36, the 2nd roller home position sensor 38, the power key 40, the START key 42, the original No. set key 43, the copy No. set key 45, the ten keys 47, the sort mode key 53 and the stack mode key 55 is inputted into input ports of microcomputers 57 and 58, which are connected to each other.

Stored in RAM in the aforesaid microcomputer 57 are data from "original No. set counter", "copy set No. counter", "total copy set No. counter", "1st discharged sheet No. counter, "sort mode flag", "target receptacle No. counter", "1st lift flag" and "2nd lift flag". The aforesaid sort mode flag becomes "1" when the sort mode key 53 is turned ON, and becomes "0" when the stack mode key 55 is turned ON. The aforesaid target receptacle No. counter counts a number of target receptacles being used in sort mode, and equals the value of the copy set No. counter. The aforesaid 1st and 2nd lift flags become "1" when the lift members 10 and 11 are raised, and become "0" when lowered.

To an output port in the aforesaid microcomputer 57 are connected the receive roller driver 8, the lift driver 13, the paper discharge roller driver 24 and so on.

Stored in RAM in the aforesaid microcomputer 58 are data from "original No. set counter", "copy set No. counter", "total copy set No. counter", "2nd discharged sheet No. counter", "sort mode flag", "target receptacle No. counter", "1st lift flag" and "2nd lift flag". The aforesaid sort mode flag becomes "1" when the sort mode key 53 is turned ON, and becomes "0" when the stack mode key 55 is turned ON. The aforesaid target receptacle No. counter counts a number of target receptacles being used in sort mode, and equals the value of the copy set No. counter. The aforesaid 1st and 2nd lift flags become "1" when the lift members 10 and 11 are raised, and become "0" when lowered.

To an output port in the aforesaid microcomputer 58 are connected the lift driver 14, the paper discharge roller driver 34 and so on.

FIGS. *7a* to *9b* illustrate in detail how the aforesaid sorter 1 operates.

When an ON signal from the aforesaid power key 40 is sent to the microcomputer 57, operation is started according to a program (shown in the flow charts in FIGS. *7a* to *8b*) incorporated in ROM in the microcomputer 57. FIGS. *7a* and *7b* show "main routine" of the flow, and FIGS. *8a* and *8b* "subroutine".

First, Step 1 initializes the sorter system to clear data in the RAM and the I/O ports in the microcomputer 57.

Second, Step 2 checks if START key 42 is turned ON or NOT. If the Step 2 determines that START key 42 has been turned ON, Step 3 turns ON the receive roller driver 8, and then, through Step 4, a target receptacle select routine, Step 5 checks if 1st lift flag=1 or NOT. If Step 5 determines that 1st lift flag is not "1", the flow goes back to Step 3. If Step 5 determines that 1st lift flag is "1", Step 6 sets ON-time of the lift driver 13 in accordance with a target receptacle 9 selected by the target receptacle select routine in Step 4.

Then, Step 7 checks if the paper sensor 35 has been turned ON or NOT. If Step 7 determines that the paper sensor 35 has been ON, i.e., the paper sensor 35 has detected a leading edge of recorded sheet P, Step 8 turns ON the paper discharge roller driver 24, and then Step 9 checks if $t_x$ is larger than or equal to $t_1$ or NOT. Here, $t_x$ is an elapse time from the instant when the paper sensor 35 became ON, and $t_1$ a time, from the instant when the paper sensor 35 became ON (when the paper discharge roller driver 24 was turned ON), required for the paper discharge rollers 17 and 23 to pinch the leading edge of recorded sheet P.

If the aforesaid Step 9 determines that $t_x$ is larger than or equal to $t_1$, Step 10 turns OFF the paper discharge roller driver 24, Step 11 turns ON the lift driver 13 to raise the paper discharge rollers 17 and 23, and goes to Step 12.

Next, Step 12 checks if the paper discharge rollers 17 and 23 have reached or NOT a receptacle 9 selected by the Step 4, target receptacle select routine, in other words, checks if the lift driver 13 kept ON or NOT for the ON-time period of the lift driver 13 set in the Step 6.

If the Step 12 determines that the paper discharge rollers 17 and 23 have reached the selected receptacle 9, Step 13 turns OFF the lift driver 13, and, after Step 14 makes the 1st lift flag "0", Step 15 turns ON the paper discharge roller driver 24 to discharge sheets P by the paper discharge rollers 17 and 23.

Next, Step 16 checks if the paper sensor 35 is turned OFF or NOT. If the Step 16 determines that the paper sensor 35 is OFF, Step 17 adds "1" to the 1st discharge paper No. counter, Step 18 puts a value of the 1st discharge paper No. counter into the 2nd discharge paper No. counter, and then Step 19 checks if $t_y$ is larger than or equal to $t_2$ or NOT, where $t_y$ is an elapse time from the instant when the Step 16 determined that the paper sensor 35 was OFF, and $t_2$ is a time, from the instant when the Step 16 determined that the paper sensor 35 was OFF, required for recorded sheet P discharged by the paper discharge rollers 17 and 23 to get out of the paper discharge rollers 17 and 23.

If the aforesaid Step 19 determines that $t_y$ is larger than or equal to $t_2$, Step 20 turns the paper discharge roller driver 24 OFF, and then Step 21 turns the lift driver 13 ON to lower the paper discharge rollers 17 and 23, and goes to Step 22.

Next, Step 22 checks if the 1st roller home position sensor 36 is turned ON or NOT. If the aforesaid Step 22 determines that the 1st roller home position sensor 36 is ON, Step 23 turns the lift driver 13 OFF to have the paper discharge rollers 17 and 23 standing by at the 1st home position, and then Step 24 checks if the total copy set No. counter equals the 1st discharged sheet No. counter or NOT. If the Step 24 determines that the total copy set No. counter does not equal the 1st discharged sheet No. counter, the flow is returned to the Step 4. When the Step 24 determines that the total copy set No. counter equals the 1st discharged sheet No. counter, a complete cycle of this operation is over.

FIGS. *8a* and *8b* show the flow chart of the target receptacle select routine, the Step 4. The operation procedure is as follows:

First, Step 25 checks if the sort mode flag equals "1" or NOT. If the Step 25 determines the sort mode flag=1, that is, the present mode is "sort mode", Step 26 finds C and D to satisfy $A-BC=D$ (where $0 \leqq D < B$), where the aforesaid A is a value of the 1st discharged sheet No. counter, B is a value of the stacked receptacle No. counter, and C and D are zero or positive integers. Next, Step 27 checks if $D=0$ or NOT. If Step 27 determines that D is NOT zero, Step 28 checks if $D=2m+1$(where $D \geqq 2m$, and m is zero or positive integer) or NOT.

If the aforesaid Step 27 determines $D=0$, Step 29 selects a central reference receptacle 9a as a target receptacle 9, Step 30 makes the 1st lift flag "1", Step 31 the 2nd lift flag "1" to return to the main routine. If the aforesaid Step 28 determines $D=2m+1$(where $D \geqq 2m$), Step 32 selects a $(m+1)$ th receptacle 9 upward from the central reference receptacle 9a as a target receptacle 9, and Step 30 makes the 1st lift flag "1", Step 31 the 2nd lift flag "1" to return to the main routine. If the aforesaid Step 28 determines that D is NOT equal to $2m+1$(where $D \geqq 2m$), Step 33 selects a m th receptacle 9 downward from the central reference receptacle 9*a* as a target receptacle 9, and Step 34 makes the 1st lift flag "0", and Step 35 the 2nd lift flag "0" to return to the main routine.

If the aforesaid Step 25 determines that the sort mode flag is NOT equal to 1, that is, the current mode is "stack mode", Step 36 finds F and G to satisfy $A-EF=G$ (where $0 \leqq G \leqq E$), where E is a maximum number of recorded sheets P stacked on a receptacle 9, and F and G are zero or positive integers. Step 37 checks $F=0$ or NOT. If Step 37 determines that F is NOT zero, Step 38 checks if $F=2n+1$(where $F \geqq 2n$, and n is 0 or positive integer) or NOT.

If the aforesaid Step 37 determines $F=0$, Step 39 selects the central reference receptacle 9*a* as a target receptacle 9, Step 40 makes the 1st lift flag "1", and Step 41 the 2nd lift flag "1" to return to the main routine. If the aforesaid Step 38 determines $F=2n+1$ (where $F \geqq 2n$), Step 42 selects a $(n+1)$ th receptacle 9 upward from the central reference receptacle 9*a* as a target receptacle 9, Step 40 makes the 1st lift flag "1", and Step 41 the 2nd lift flag "1" to return to the main routine. If the aforesaid Step 38 determines that F is NOT equal to $2n+1$ (where $F \geqq 2n$), Step 43 selects a n th receptacle 9 downward from the central reference receptacle 9*a* as a target receptacle 9, Step 44 makes the 1st lift flag "0", and Step 45 the 2nd lift flag "0" to return to the main routine.

Figure 8A:
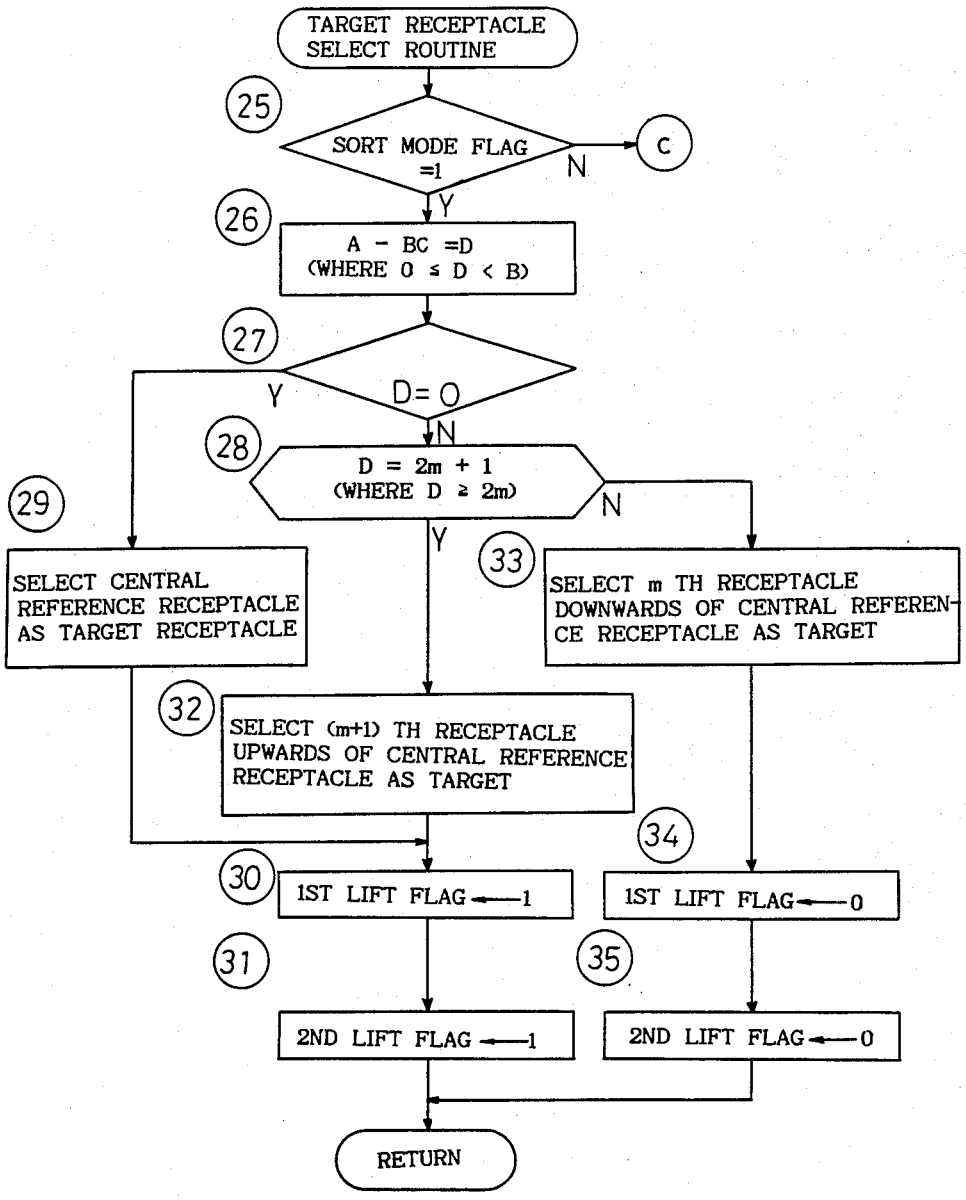
Figure 8B:
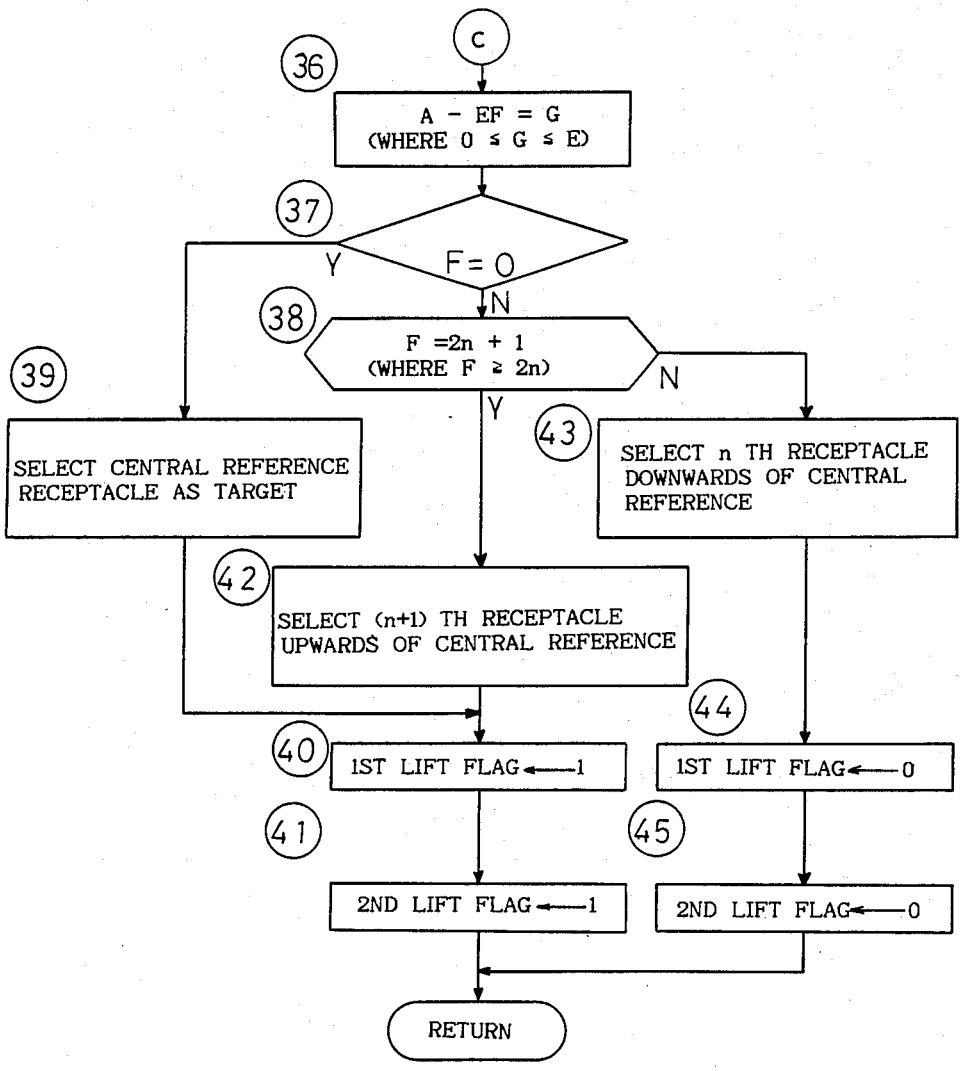
Figure 9A:
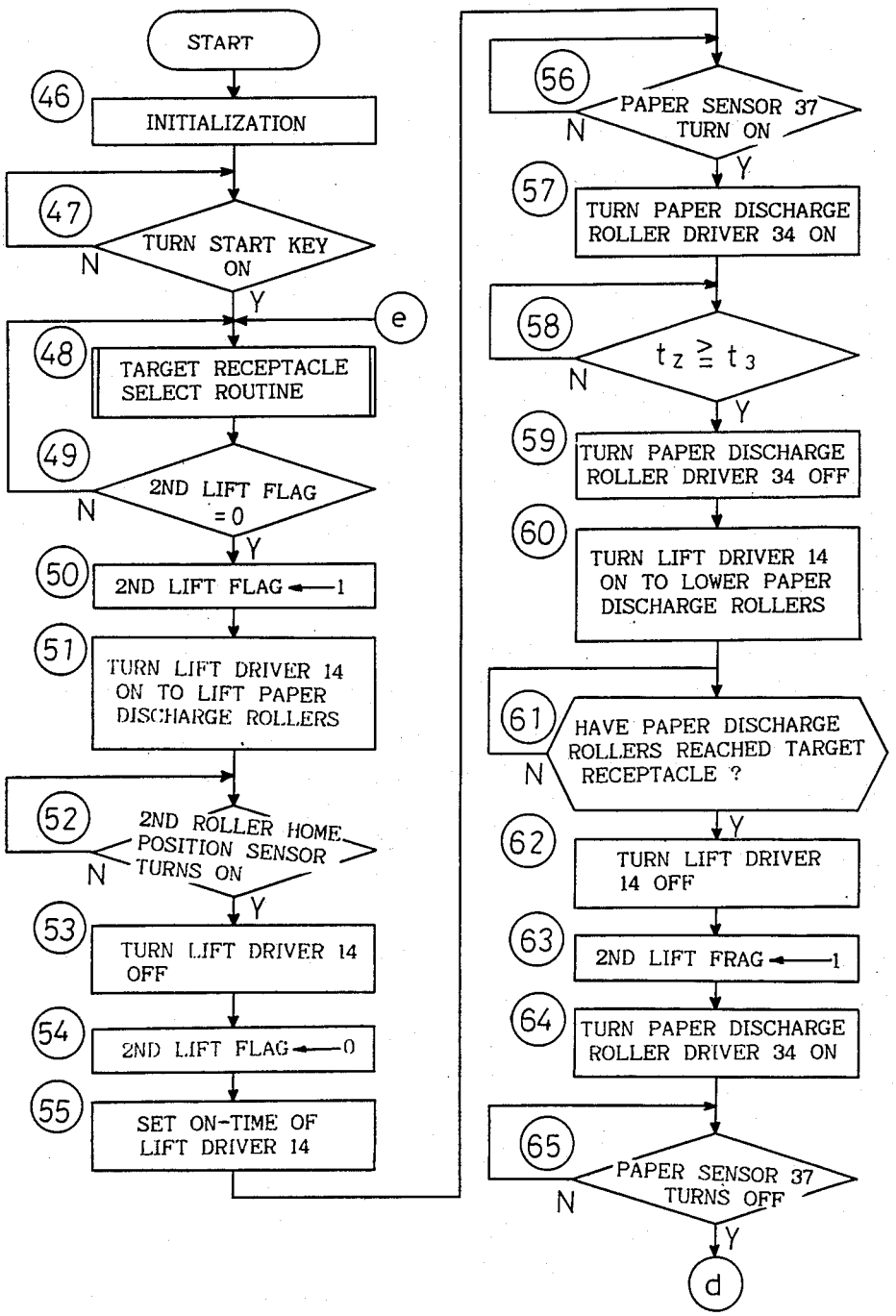
Figure 9B:
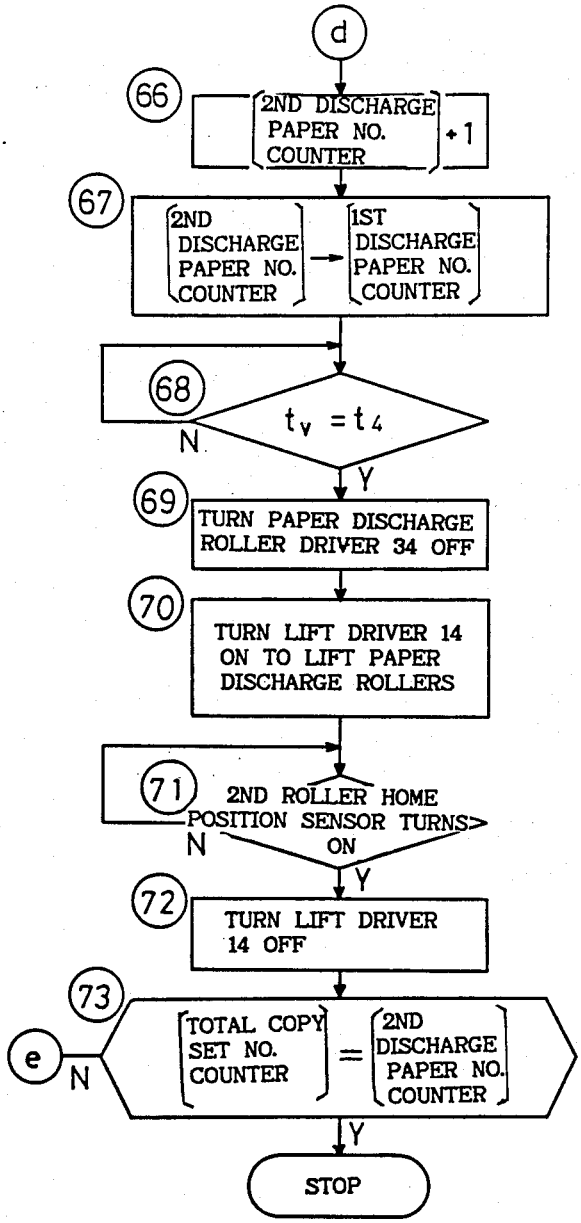

When the microcomputer 58 receives a signal showing that the aforesaid power key 40 is turned ON, recorded sheets of paper P are sorted according to a program shown by the flow charts in FIGS. 8*a*, 8*b*, 9*a* and 9*b*, which is incorporated in the ROM in the microcomputer 58. FIGS. 9*a* and 9*b* show a main routine in the flow and FIGS. 8*a* and 8*b* a subroutine.

First, Step 46 initializes the sorter system to clear data in the RAM and the I/O ports in the microcomputer 58.

Second, Step 47 checks if START key 42 is turned ON or NOT. If the Step 47 determines that START key 42 has been turned ON, through Step 48, a target receptacle select routine, Step 49 checks if 2nd lift flag=0 or NOT. If Step 49 determines that the 2nd lift flag is NOT "0", the flow goes back to Step 48. If Step 49 determines that the 2nd lift flag is "0", Step 50 makes the 2nd lift flag "1", Step 51 turns ON the lift driver 14 to raise the paper discharge rollers 27 and 33, and then Step 52 checks if the 1st roller home position sensor 36 is turned ON or NOT. If Step 52 determines that the 1st roller home position sensor 36 is turned ON, Step 53 turns OFF the lift driver 14 to keep the paper discharge rollers 27 and 33 on standby at the 1st home position for receiving recorded sheets of paper P (in this case the lift member 10 takes a position upward of the 1st home position), Step 54 makes the 2nd lift flag "0", and then Step 55 sets ON-time of the lift driver 14 in accordance with a target receptacle 9 selected by the target receptacle select routine in Step 48.

Then, Step 56 checks if the paper sensor 37 has been turned ON or NOT. If Step 56 determines that the paper sensor 37 has been ON, i.e., the paper sensor 37 has detected a leading edge of recorded sheet P, Step 57 turns ON the paper discharge roller driver 34, and then Step 58 checks if $t_z$ is larger than or equal to $t_3$ or NOT. Here, $t_z$ is an elapse time from the instant when the paper sensor 37 became ON, and $t_3$ a time, from the instant when the paper sensor 37 became ON (when the paper discharge roller driver 34 was turned ON), required for the paper discharge rollers 27 and 33 to pinch the leading edge of recorded sheet P.

If the aforesaid Step 58 determines that $t_z$ is larger than or equal to $t_3$, Step 59 turns OFF the paper discharge roller driver 34, Step 60 turns ON the lift driver 14 to lower the paper discharge rollers 27 and 33, and goes to Step 61.

Next, Step 61 checks if the paper discharge rollers 27 and 33 have reached or NOT a receptacle 9 selected by the Step 48, target receptacle select routine, in other words, checks if the lift driver 14 kept ON or NOT for the ON-time period of the lift driver 14 set in the Step 55.

If the Step 61 determines that the paper discharge rollers 27 and 33 have reached the selected receptacle 9, Step 62 turns OFF the lift driver 14, and, after Step 63 makes the 2nd lift flag "1", Step 64 turns ON the paper discharge roller driver 34 to discharge sheets P by the paper discharge rollers 27 and 33.

Next, Step 65 checks if the paper sensor 37 is turned OFF or NOT. If the Step 65 determines that the paper sensor 37 is OFF, Step 66 adds "1" to the 2nd discharge paper No. counter, Step 67 puts a value of the 2nd discharge paper No. counter into the 1st discharge paper No. counter, and then Step 68 checks if $t_v$ is larger than or equal to $t_4$ or NOT, where $t_v$ is an elapse time from the instant when the Step 65 determined that the paper sensor 37 was OFF, and $t_4$ is a time, from the instant when the Step 65 determined that the paper sensor 37 was OFF, required for recorded sheet P discharged by the paper discharge rollers 27 and 33 to get out of the paper discharge rollers 27 and 33.

If the aforesaid Step 68 determines that $t_v$ is larger than or equal to $t_4$, Step 69 turns the paper discharge roller driver 34 OFF, and then Step 70 turns the lift driver 14 ON to raise the paper discharge rollers 27 and 33, and goes to Step 71.

Next, Step 71 checks if the 2nd roller home position sensor 38 is turned ON or NOT. If the aforesaid Step 71 determines that the 2nd roller home position sensor 38 is ON, Step 72 turns the lift driver 14 OFF to have the paper discharge rollers 27 and 33 standing by at the 2nd home position, and then Step 73 checks if the total copy set No. counter equals the 2nd discharged sheet No. counter or NOT. If the Step 73 determines that the total copy set No. counter does not equal the 2nd discharged sheet No. counter, the flow is returned to the Step 48. When the Step 73 determines that the total copy set No. counter equals the 2nd discharged sheet No. counter, a complete cycle of this operation is over.

FIGS. 8*a* and 8*b* shows the flow chart of the Target Receptacle Select Routine, the Step 48.

Figure 10:
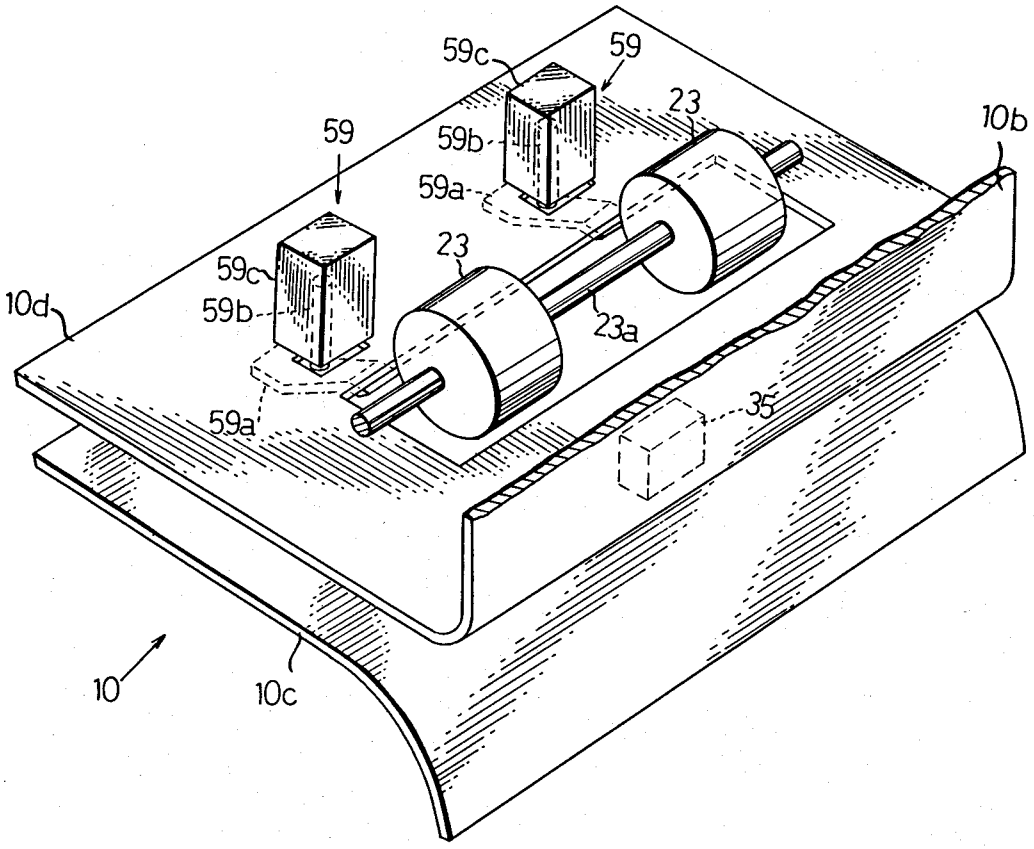
FIG. 10 is a perspective view showing a modification of the sheet pincher shown in FIGS. 1 to 4.

In the aforesaid embodiment, a recorded sheet pincher 59 is so provided that, while the aforesaid paper discharge rollers 17 and 23 are moving toward a receptacle 9 selected, the recorded sheet pincher 59 momentarily holds a leading edge of a recorded sheet P using the paper discharge rollers 17 and 23 themselves. Instead, as shown in FIG. 10, a separate recorded sheet pincher 59 rather than the paper discharge rollers 17 and 23 themselves may momentarily hold a leading edge of a recorded sheet P inserted into the paper discharge rollers 17 and 23. The separate recorded sheet pincher 59 consists of two pinch piece 59*a*, which are fixed to a lower face of the guide member 10*d* and can be easily deformed elastically, and two solenoids 59*c* which are fixed to an upper face of the guide member 10*d* and dislocate the elastic pinch pieces 59*a* downwards with actuators 59*b* through openings in the guide member 10*d*. While the solenoids 59*c* are turned OFF, the aforesaid elastic pinch pieces 59*a* are so removed from the guide member 10*c* that they could not hamper the movement of recorded sheets P. If the solenoids 59*c* are turned ON, when a leading edge of recorded sheet P reaches in between the elastic pinch pieces 59*a* and the guide member 10*c* with the recorded sheet P pinched in between the aforesaid paper discharge rollers 17 and 23, the actuators 59*b* in the solenoids 59*c* dislocate the elastic pinch pieces 59*a* downwards so that the elastic pinch pieces 59*a* pinch the recorded sheet P with the guide member 10*c* while pressing the recorded sheet P down on the guide member 10*c*.

Figure 11:
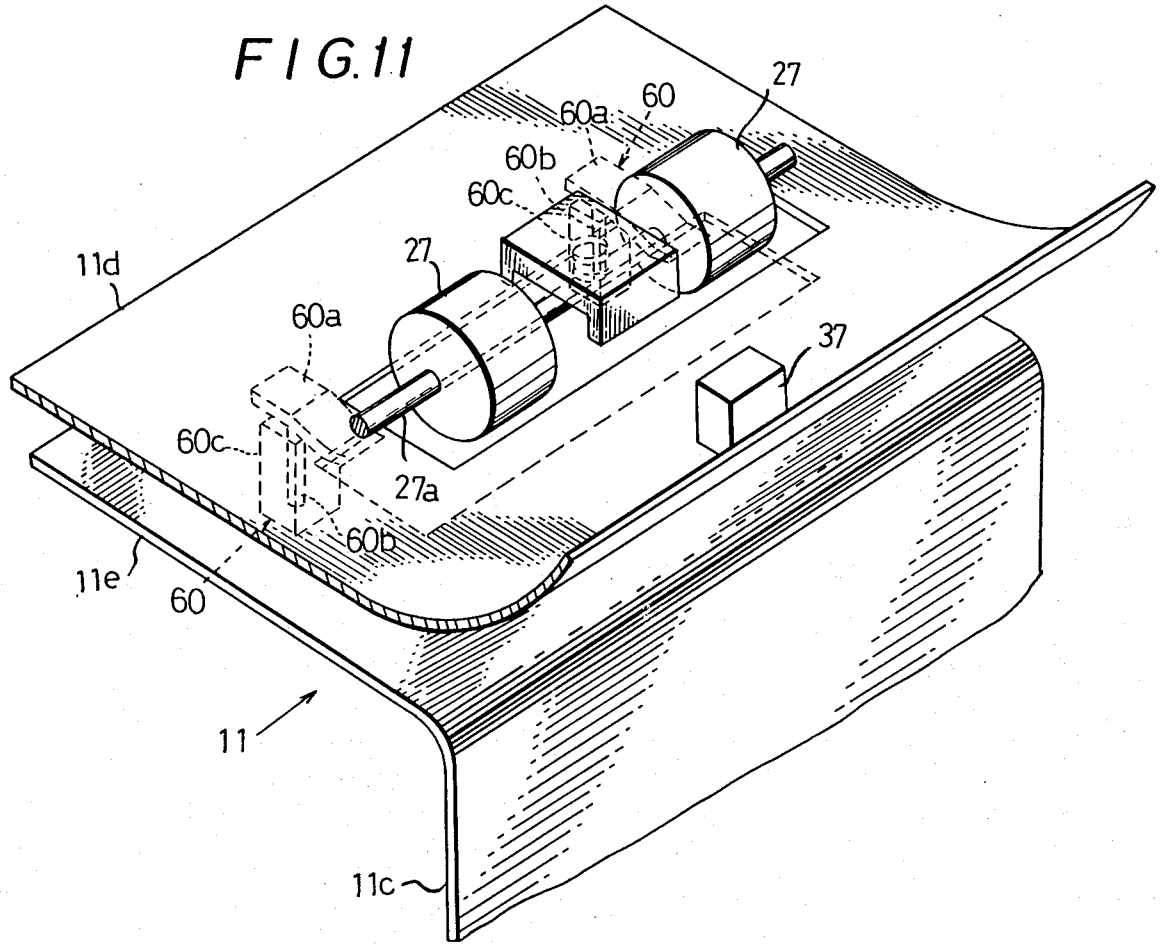
FIG. 11 is a perspective view showing another modification of the sheet pincher.

In the aforesaid embodiment, a recorded sheet pincher 60 is so provided that, while the aforesaid paper discharge rollers 27 and 33 are moving toward a receptacle 9 selected, the recorded sheet pincher 60 momentarily holds a leading edge of a recorded sheet P using the paper discharge rollers 27 and 33 themselves. Instead, as shown in FIG. 11, a separate recorded sheet pincher 60 rather than the paper discharge rollers 27 and 33 themselves may momentarily hold a leading edge of a recorded sheet P inserted into the paper discharge rollers 27 and 33. The separate recorded sheet pincher 60 consists of two pinch piece 60*a*, which are fixed to an upper face of the guide member 11*e* and can be easily deformed elastically, and two solenoids 60*c* which are fixed to a lower face of the guide member 11*e* and dislocate the elastic pinch pieces 60*a* upwards with actuators 60*b* through openings in the guide member 11*e*. While the solenoids 60*c* are turned OFF, the aforesaid elastic pinch pieces 60*a* are so removed from the guide member 11*d* that they could not hamper the movement of recorded sheets P. If the solenoids 60*c* are turned ON, when a leading edge of recorded sheet P reaches in between the elastic pinch pieces 60*a* and the guide member 11*d* with the recorded sheet P pinched in between the aforesaid paper discharge rollers 27 and 33, the actuators 60*b* in the solenoids 60*c* dislocate the elastic pinch pieces 60*a* upwards so that the elastic pinch pieces 60*a* pinch the recorded sheet P with the guide member 11*d* while pressing the recorded sheet P down on the guide member 11*d*.

The above description is for a case where the first invention is applied to an electronic copying machine, but the invention can be adaptable for sorting recorded sheets sent from a printer and other image recording machines.

The aforesaid sorter according to the invention has a short movement, that is, a fast sorting of recorded sheets, because two pairs of paper discharge rollers, located around the center of vertically disposed receptacles, alternatively stand by at respective home positions receiving recorded sheets so that respective pairs of paper discharge rollers alternatively discharge recorded sheets on receptacles, and because the lifting or lowering range of each pair of paper discharge rollers to sort recorded sheets is essentially half the distance between the highest receptacle to the lowest.

Figure 12:
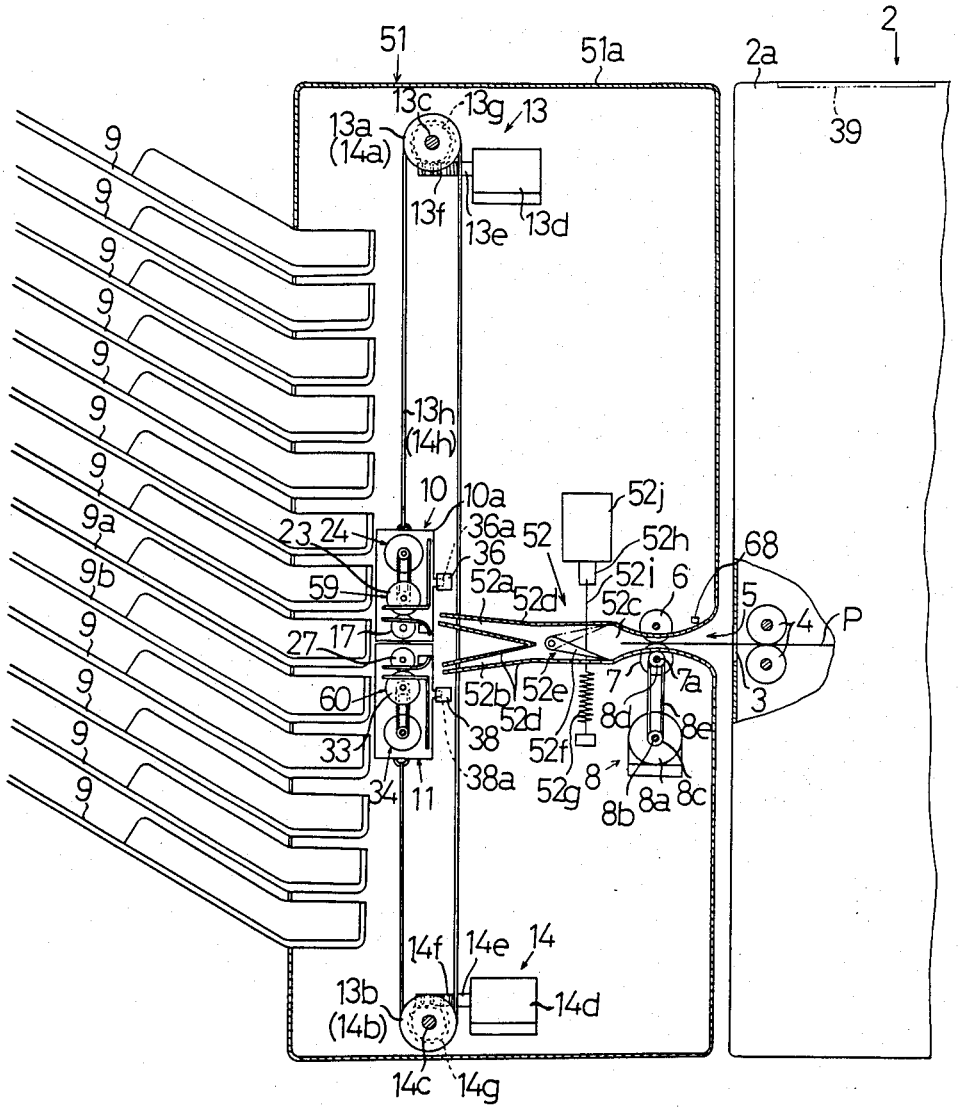
FIG. 12 is a side sectional view of a second embodiment according to the invention.
Figure 13A:
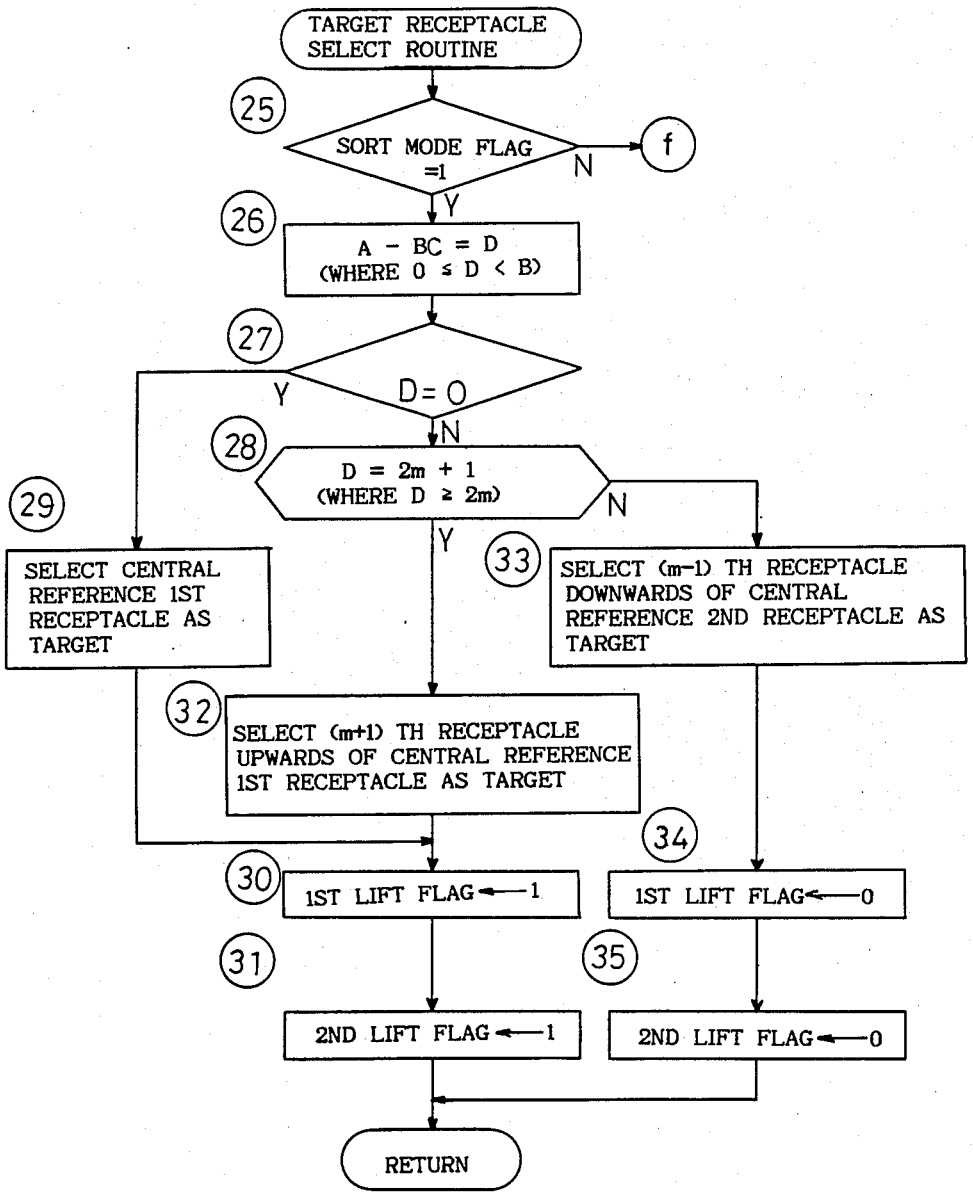
FIGS. 13*a* to 15 are control flow charts of the second embodiment.
Figure 13B:
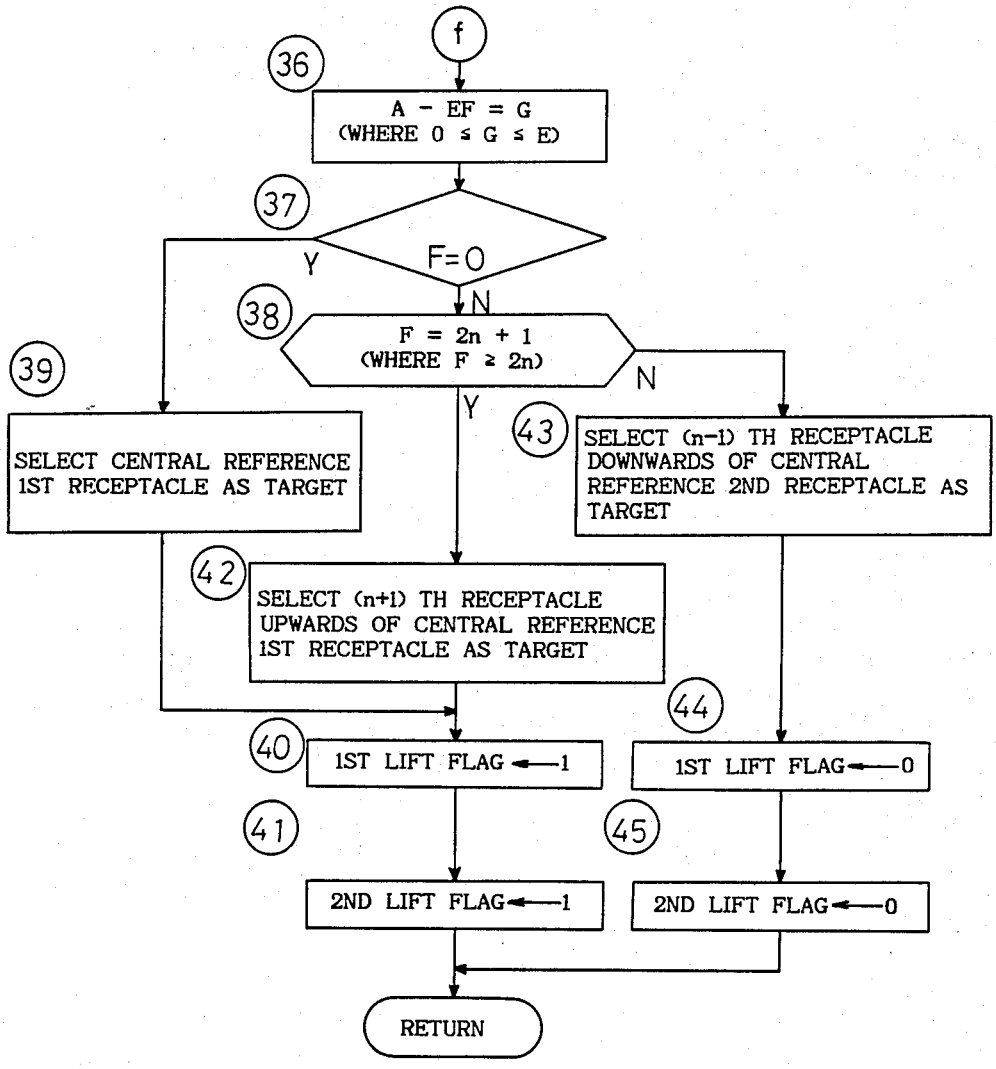

FIG. 12 shows a second embodiment of the invention. The same parts and members in this embodiment as those in the aforesaid embodiment shown in FIG. 1 have the same numerals, whose description is omitted. In the sorter 51 associated with the 2nd embodiment, only a paper guide 52 is different from the paper guide 12 in FIG. 1, which makes a slight difference in how to sort recorded sheets.

In FIG. 12, a paper receive sensor 68 of a photosensor type is disposed in between the paper discharge rollers 4 and the receive rollers 6 and 7 to detect recorded sheets P being inserted into the paper receive port 5. A paper (sheet) guide 52 consists of a plurality of guide members 52*d* having a 1st paper path 52*a* to guide recorded sheets onto a 1st reference receptacle 9*a* locating at the center of the receptacles 9, a 2nd paper path 52*b* to guide recorded sheets P onto a 2nd reference receptacle 9*b* locating just below and adjacent to the aforesaid 1st reference receptacle 9*a*, and a paper common path 52*c* to guide recorded sheets P sent from the receive rollers 6 and 7 before recorded sheets are divided into the aforesaid 1st and 2nd paper paths 52*a* and 52*b*, as well as a paper direction changer 52*e* to guide recorded sheets P carried into the paper common path 52*c* of these guide members 52*d* into either the 1st paper path 52*a* or the 2nd paper path 52*b*.

The aforesaid paper direction changer 52*e* consists of a paper direction change member 52*f* rotatably disposed in a paper common path 52*c* of the guide member 52*d*, a tension spring 52*g* elastically pressing down the paper direction change member 52*f* to the lower side of the guide member 52*d*, and a solenoid 52*j* disposed above the guide member 52*d* and connected to a swing end of the paper direction change member 52*f* through a wire 52*i* and actuator 52*h*.

When the aforesaid solenoid 52*j* is turned OFF, the paper direction change member 52*f* is deployed in a solid-line position to guide recorded sheets P sent from the receive rollers 6 and 7 toward the 1st paper path 52*a*, and When the solenoid 52*j* is turned ON, the paper direction change member 52*f* is deployed in a dashed-line position to guide recorded sheets P sent from the receive rollers 6 and 7 toward the 2nd paper path 52*a*.

In the first embodiment shown in FIG. 1, a 1st roller home position sensor 36 is provided for detecting that one pair of the paper discharge rollers 17 and 23 has been deployed at a 1st home position matching the central reference receptacle, and a 2nd roller home position sensor 38 is provided for detecting that the other pair of the paper discharge rollers 27 and 33 has been deployed at a 2nd home position matching a receptacle just below the central reference receptacle. Instead, in the second embodiment shown in FIG. 12, a 1st roller home position sensor 36 is provided for detecting that one pair of the paper discharge rollers 17 and 23 has been deployed at a 1st home position matching the aforesaid 1st central reference receptacle 9*a*, and a 2nd roller home position sensor 38 is provided for detecting that the other pair of the paper discharge rollers 27 and 33 has been deployed at a 2nd home position matching the aforesaid 2nd central reference receptacle.

A control device in use for the second embodiment is similar to the control device in the first embodiment illustrated by FIG. 6. The difference is shown by chain lines : a paper receive sensor 68 is newly connected to input ports of the microcomputers 57 and 58, and a paper direction changer 52*e* is added to an output port of the microcomputer 58.

Figure 7A:
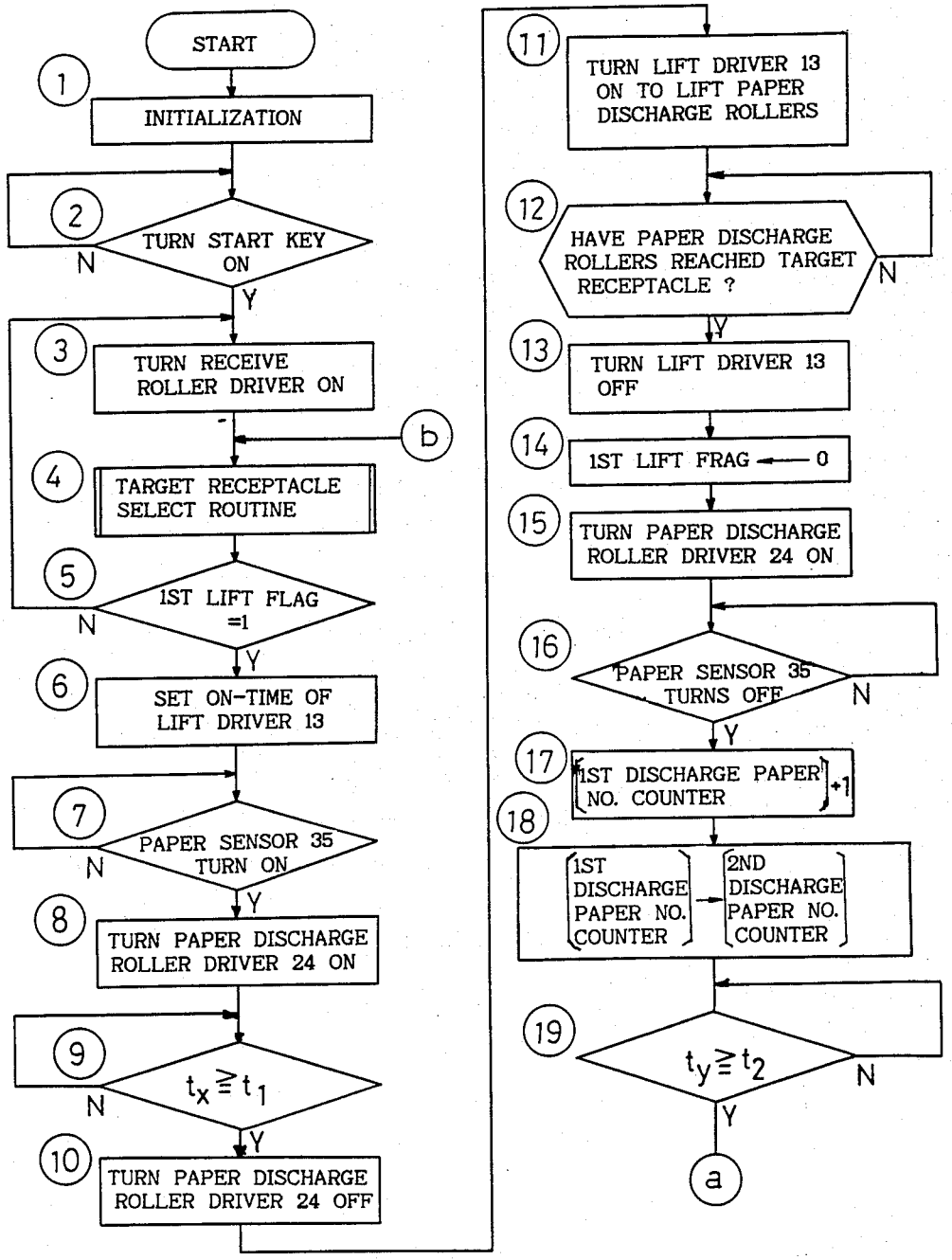
FIGS. 7*a* to 9*b* are control flow charts of the first embodiment.
Figure 7B:
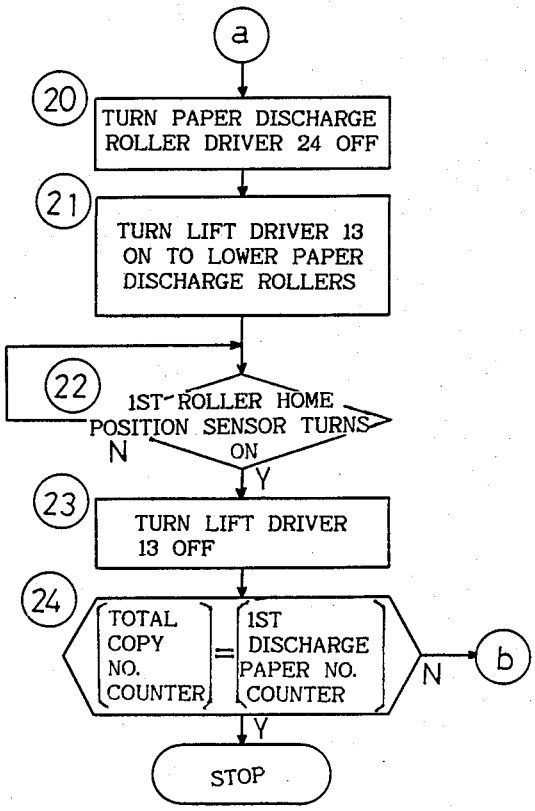

The operation of the sorter 51 is described below using the flow charts given in FIGS. 13*a* to 15. The mainflow which is executed by the microcomputer 57 in the sorter 51 is the same as in the aforesaid embodiment given in FIGS. 7*a* and 7*b*. Step 4, Target Receptacle Select Routine, in this mainflow is shown in FIGS.

13*a* and 13*b*. Steps 25 to 28 in this routine are the same as those in the aforesaid embodiment in FIGS. 8*a* and 8*b*. In this routine when Step 27 determines D is "0", Step 29 selects a central 1st reference receptacle 9*a* as a target receptacle, Step 30 makes the 1st lift flag "1", and Step 31 also makes the 2nd lift flag "1" to return to the main routine. Here, when the aforesaid Step 28 determines $D=2m+1$ (where $D \geqq 2m$), Step 32 selects a $(m+1)$ th receptacle upward of the central 1st reference receptacle 9*a* as a target receptacle 9, Step 30 makes the 1st lift flag "1" and Step 31 makes the 2nd lift flag "1" to return to the main routine. If the aforesaid Step 28 determines D is Not equal to $2m+1$ (where $D \geqq 2m$), Step 33 selects a $(m-1)$ th receptacle downward of the central 2nd reference receptacle 9*b* as a target receptacle 9, Step 34 makes the 1st lift flag "0" and Step 35 makes the 2nd lift flag "0" to return to the main routine.

When Step 25 determines "sort mode" flag is Not "1", following steps to Step 38 are the same as shown in FIG. 9. In this case when the aforesaid Step 37 determines $F=0$, Step 39 selects the central 1st reference receptacle 9*a* as a target receptacle 9, Step 40 makes the 1st lift flag "1", and Step 41 makes the 2nd lift flag "1" to return to the main routine. If the aforesaid Step 38 determines $F=2n+1$ (where $F \geqq 2n$), Step 42 selects a $(n+1)$ th receptacle 9 upward of the central 1st reference receptacle 9*a* as a target receptacle, Step 40 makes the 1st lift flag "1" and Step 41 makes the 2nd lift flag "1" to return to the main routine. If the aforesaid Step 38 determines $F=2n+1$ (where $F \geqq 2n$) does Not hold, Step 43 selects a $(n-1)$ th receptacle 9 downward of the central 2nd reference receptacle 9*b* as a target receptacle 9, Step 44 makes the 1st lift flag "0" and Step 45 makes the 2nd lift flag "0" to return to the main routine.

Figure 14A:
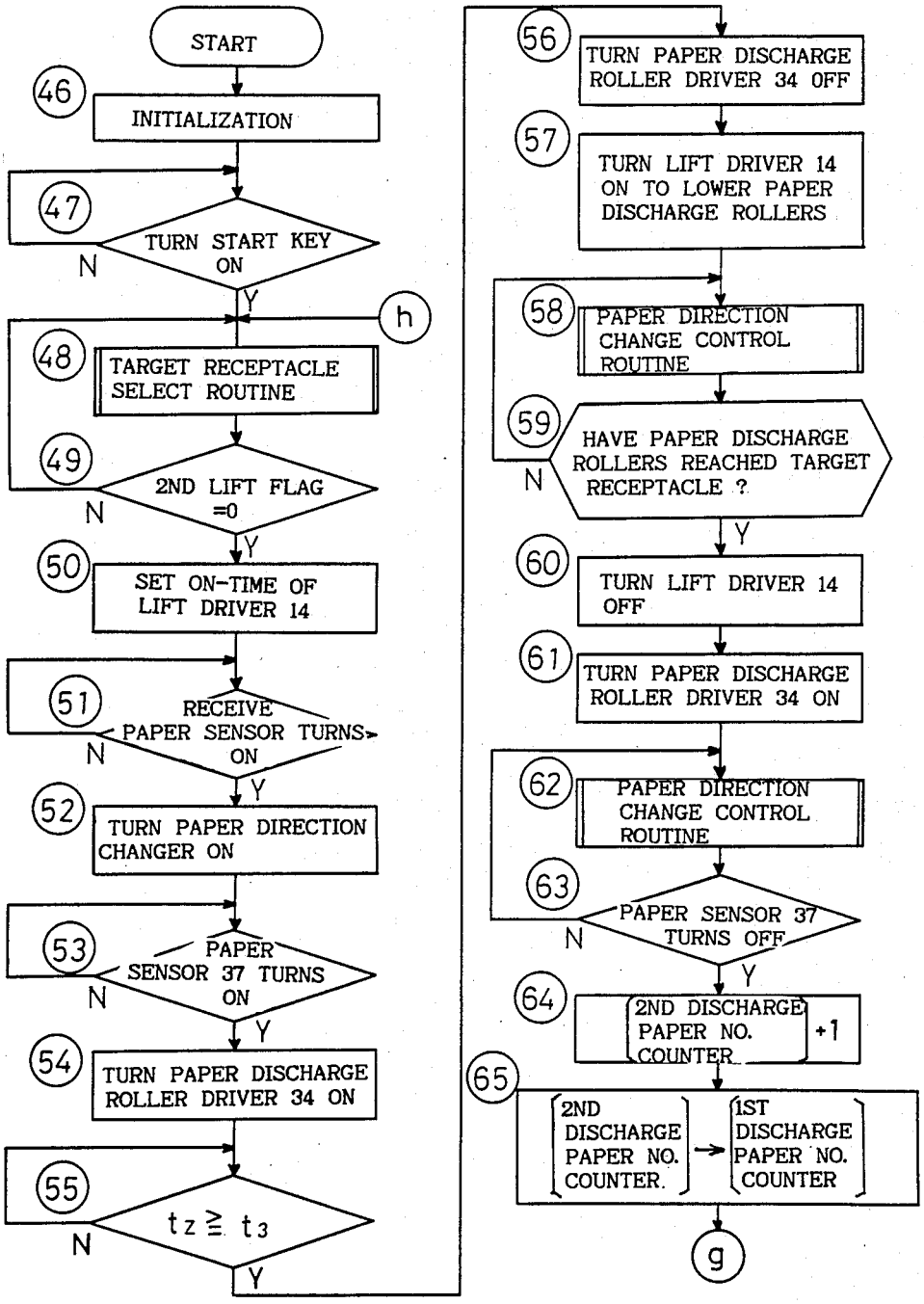
Figure 14B:
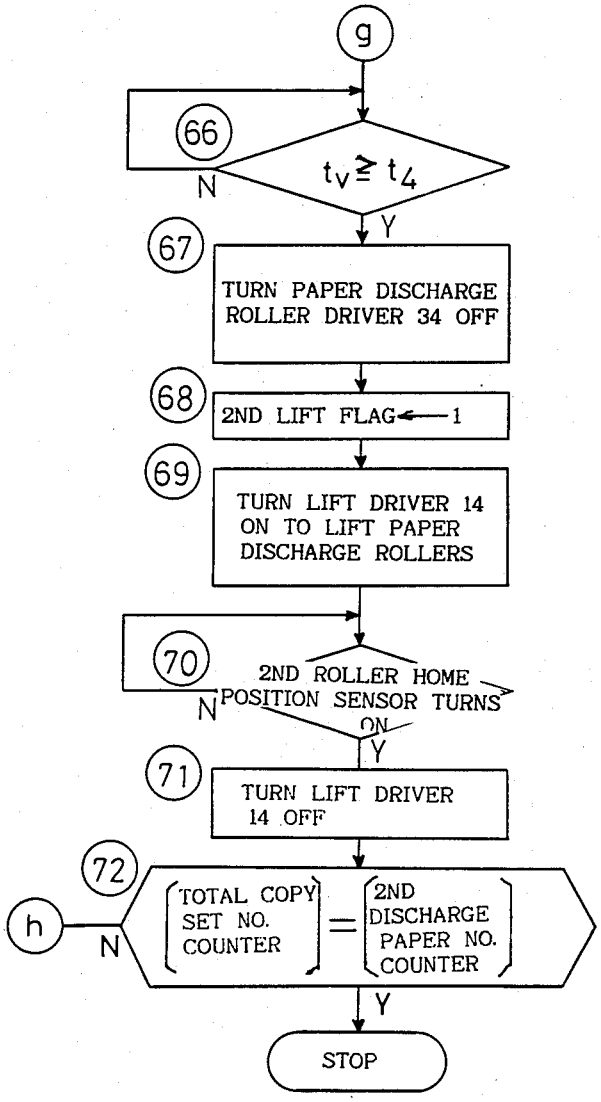
Figure 15:
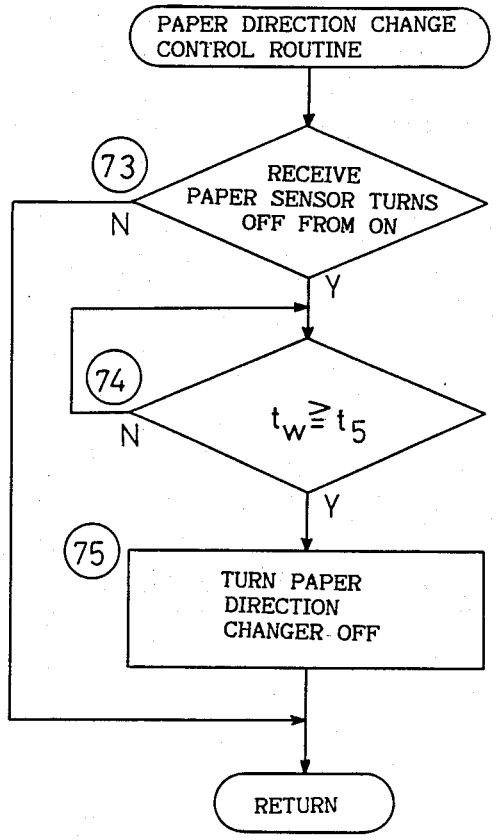

The control by the microcomputer 58 in the sorter 51 is executed according to the flowcharts in FIGS. 14*a*, 14*b* and 15. Steps 46 to 49 in FIG. 14*a* are the same as those in the aforesaid embodiment in FIG. 9*a*. Here if Step 49 determines the 2nd lift flag=0, Step 50 sets an ON time for the lift driver 14 according to the receptacle 9 selected by the Receptacle Select Routine in Step 48. Next, Step 51 checks whether the paper receive sensor 8 is ON or NOT. When Step 51 determines the paper receive sensor 8 is ON, Step 52 energizes the paper direction changer 12*e*. Then Step 53 checks if the paper sensor 37 is ON or Not. When Step 53 determines the paper sensor 37 is ON, in other words, when the paper sensor 37 has detected a leading edge of a recorded sheet P, Step 54 energizes the paper discharge roller driver 34, and Step 55 checks if $t_z \geqq t_3$. When the aforesaid Step 55 determines $t_z \geqq t_3$, Step 56 turns the paper discharge roller driver 34 OFF, Step 57 turns the lift driver 14 ON to lower the paper discharge rollers 27 and 33 and proceeds to Step 59 through Step 58, Paper Direction Change Control Routine.

Step 59 checks if the paper discharge rollers 27 and 33 have reached the receptacle 9 selected in Step 48, Target Receptacle Select Routine.

If the aforesaid Step 59 determines the paper discharge rollers 27 and 33 have not reached the selected receptacle 9, the flow loops back to Step 58. If Step 59 determines the paper discharge rollers 27 and 33 have reached the selected receptacle 9, Step 60 turns the lift driver 14 OFF, Step 61 turns the paper discharge roller driver 34 ON, to discharge the recorded sheet P onto the receptacle using the paper discharge rollers 27 and 33, and Step 62 executes the Paper Direction Change Control Routine and finally Step 63 checks if the paper sensor 37 is turned OFF or Not. When Step 63 judges the paper sensor 37 is NOT turned OFF, the flow loops back to Step 62. If Step 63 determines the paper sensor 37 is turned OFF, Steps 63 to 66 execute the same operations as those in the Steps 65 to 68 in FIG. 9*a*.

If Step 66 determines $t_y \geqq t_4$, Step 67 turns the paper discharge roller driver 34 OFF and then Step 68 sets the 2nd lift flag to "1" and Step 69 turns the lift driver 14 ON to lift the paper discharge rollers 27 and 33, and proceeds to Step 70. Steps 70 to 72 are the same as those Steps 71 to 73 in FIG. 9*a*.

Next, FIG. 15 shows the aforesaid Steps 58 and 62, the Paper Direction Change Routine as follows.

Step 73 checks if the paper receive sensor 8 has been turned OFF from ON. If Step 73 determines the paper receive sensor 8 has not yet been turned OFF from ON, the flow goes back to the main routine. When Step 73 determines the paper receive sensor 8 has been turned OFF from ON, Step 74 checks if $t_w \geqq t_5$, where $t_w$ is an elapsed time from the instant when the paper receive sensor 8 is turned OFF from ON, and $t_5$ is a time, from the instant when the paper receive sensor 8 is turned OFF from ON, required for a trailing edge of a recorded sheet P to pass the paper direction change member 12*f*. When Step 74 determines $t_w \geqq t_5$, Step 75 turns OFF the paper direction changer 12*e* to return to the main routine.

Sorting speed of recorded sheets can be increased by a sorter in FIGS. 12 to 15 as well.

Figure 16:
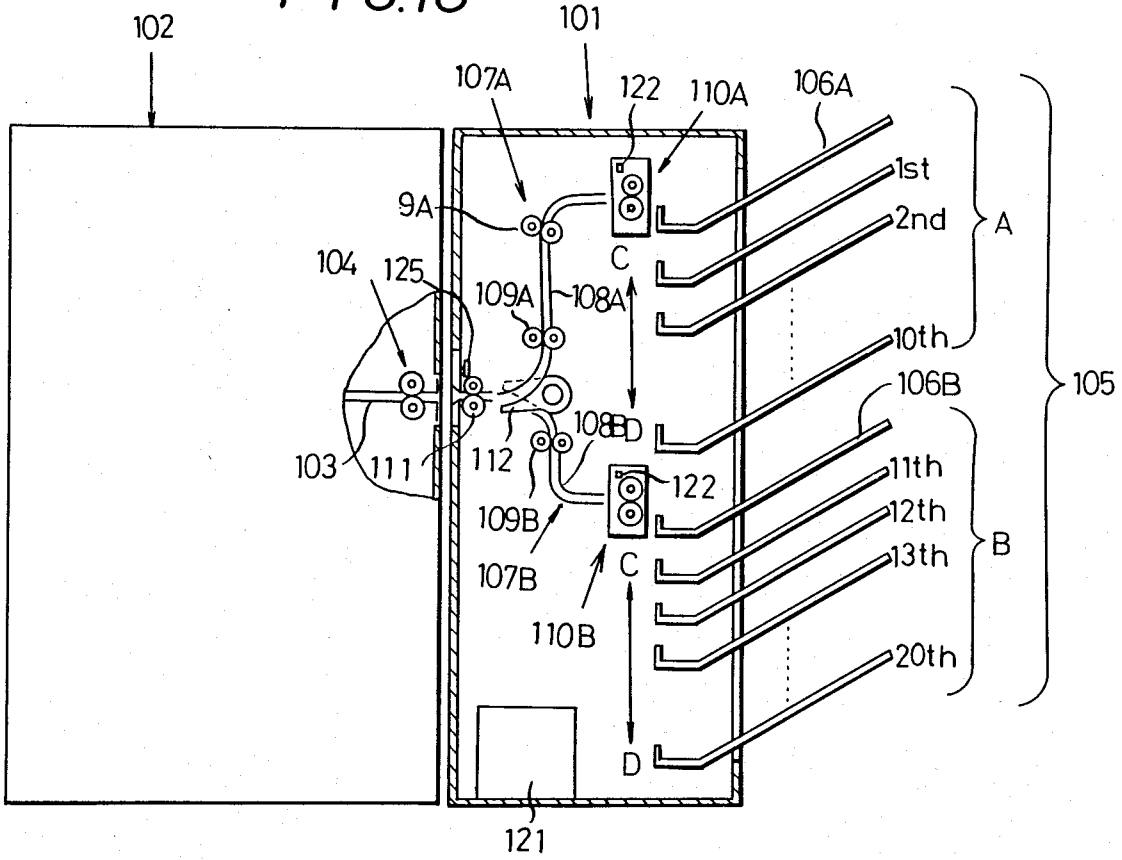
FIG. 16 is a side sectional view of a third embodiment according to the invention.

FIG. 16 depicts another embodiment of the invention. This embodiment allows, in particular when sheets of recorded paper are jammed in the sorter, following recorded sheets not involved in the jam to be processed safely.

A sorter 101 in FIG. 16, an embodiment in accordance with the invention, is attached to an electronic copying machine 102 handling sheets of recorded paper. A mechanism of the type of copying machine 102 has been so popular that no further explanation is needed here excepting that in this type of copying machine sheets of recorded paper (what are called copies) discharged from the copying machine 102 are sent to the sorter 101 through a paper discharge path 103 and a pair of paper discharge rollers 104.

This sorter 101 is provided with more than one (for instance 22 here) sorter receptacles 105 which are divided into two groups, group A and group B. Each of A and B groups is composed of 11 receptacles, and receptacles located at a top of each group, or a 1st reference receptacle 106A and a 2nd reference receptacle 106B, serve especially as paper discharge receptacles (detailed description is given later).

A sheet transfer means 107A is attached to the receptacle group A and another sheet transfer means 107B to the group B. The sheet transfer 107A consists of a sheet transfer path 108A, transfer rollers 109A and a sheet distributor 110A to carry copied products (from now on only referred to as "sheet") from a pair of the paper discharged rollers 104 of the copying machine 102 to each sorter receptacle of the group A. The other sheet transfer means 107B consists also of a sheet transfer path 108B, transfer rollers 109B and a sheet distributor 110B to carry sheets discharged from the copying machine 102 to each sorter receptacle of the group B. Either the sheet transfer path 108A or 108B can be connected to a downstream side (right half of the figure) of sheet receive rollers 111 with a transfer path switching claw 112 disposed between them to complete the sheet transfer path 108A or 108B. The transfer path switching claw 112 is lowered to a position indicated by a solid line to form the upper sheet transfer path 108A. And also, the transfer path switching claw 112 is lifted as shown by broken line to form the lower sheet transfer path 108B. The transfer path switching claw 112 is triggered by a driving means like a solenoid coil (not shown).

Figure 17:
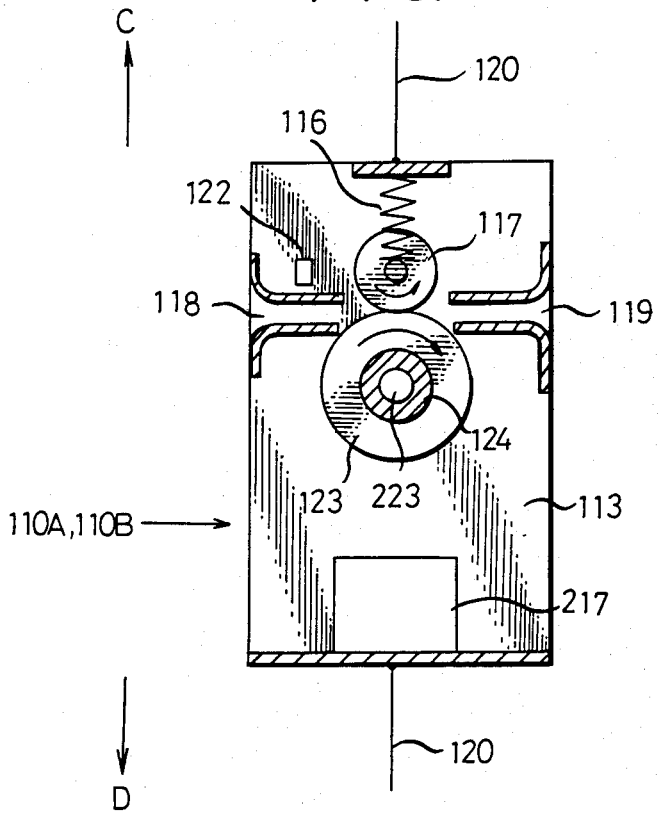
FIG. 17 is a side sectional view showing the lift member, etc. in the third embodiment.

As depicted in FIG. 17, the sheet distributors 110A and 110B are composed of a driving roller 123 mounted on a lift member 113 and a driven roller 117 pressed down to the driving roller 123 to be driven thereby. A spring 116 is provided to push the driven roller 117 against the driving roller 123. The driving roller 123 coupled to a motor 217 through a power transmission system (not shown) (for instance a pulley-and-wire wrapping connector) rotates clockwise with good timing.

Respective sheet receive slots 118 are connected to the sheet transfer path 108A or 108B, when respective sheet distributors 110A and 110B are at top positions of respective receptacle groups A and B as shown in FIG. 16, in other words, when the sheet distributor 110A is at a position (1st home position) matching the top receptacle 106A, and when the sheet distributor 110B is at a position (2nd home position) matching the other top receptacle 106B. When the respective sheet distributors 110A and 110B are at the aforesaid respective 1st and 2nd home positions, respective sheet discharge ports 119 in the sheet distributors 110A and 110B come adjacent to the respective paper discharge receptacles, the 1st and 2nd reference receptacles 106A and 106B.

As depicted in FIG. 17, the sheet distributors 110A and 110B respectively can be moved up and down in directions shown by arrows C and D, by pulling a wire 120 tied to upper and lower ends of the lift member 113 and connected to a pulley and motor or other driving means (not shown). The directions indicated by the arrows C and D in FIG. 17 are the same as those shown by the arrows C and D in FIG. 16.

The operation of the transfer path switching claw 112 and the sheet distributors 110A and 110B is controlled by a self-contained microcomputer in a controller 121 disposed on a bottom of the sorter 101 shown in FIG. 16. A program stored in ROM of the microcomputer performs such a sheet sorting operation as follows: Take up a case where five copies of an original made of more than one pages are to be produced. In this case, five sheets of each page are first copied and then each sheet is sorted one by one onto five sorter receptacles 105.

To begin with, when a first copied sheet of the first page discharged from the pair of the paper discharge rollers 104 in the copying machine 102 is sent to the pair of the sheet receive rollers 111, the transfer path switching claw 112 is at a lower position as shown by the solid line. Therefore, the aforesaid copied sheet is sent to the upper sheet distributor 110A by the transfer rollers 109A.

On the sheet receive slot 118 in the sheet distributor 110A, a sheet detect sensor 122, for example, a reflecting type of photo sensor, is disposed to detect a leading edge of the copied sheet coming into the sheet receive slot 118. Detecting the leading edge of the copied sheet, the sheet detect sensor 122 sends out a signal (sheet detect signal) to the controller 121 in FIG. 16, which allows the driving roller 123 to rotate for a given short time and come to a halt. By the instantaneous rotation and the stop thereafter of the driving roller 123, the copied sheet coming into the sheet receive slot 118 comes to a stop with its leading edge held between the driving roller 123 and the driven roller 117.

When the first copied sheet is held as described above, the controller 121 (FIG. 16) pulls the wire 120 (FIG. 17) downwards (in the direction shown by the arrow D) to bring the lift member 113 to a position in front of the 1st sorter receptacle 105 and to a halt. ( Sorter receptacles arranged below the sheet discharge receptacle 106A are referred to as a 1st sorter receptacle, a 2nd, a 3rd, . . . and a 10th from top to bottom, and sorter receptacles arranged below the paper discharge receptacle 106B are denoted as a 11th, a 12th, a 13th, . . . and a 20th also from top to bottom.) Then, the driving roller 123 is again rotated to discharge out the copied sheet that has been pinched onto the 1st sorter receptacle by way of the sheet discharge slot 119. To ensure the function of the driving roller 123 and the driven roller 117 for holding the copied sheet therebetween, as shown in FIG. 17, it is desirable to provide a one-way clutch 124 in between the driving roller 123 and a driving shaft 223 to prevent the driving roller 123 from rotating counterclockwise. Immediately after the copied sheet is discharged onto the 1st sorter receptacle, the sheet distributor 110A rises to the 1st home position matching the paper discharge receptacle 106A to stand by.

While the 1st copied sheet is transferred as described above, the second copied sheet is carried into the sheet receive rollers 111 from the copying machine 102. By this time, the transfer path switching claw 112 has been switched to an upper position indicated by the broken line, and the 2nd copied sheet is fed into the lower sheet transfer path 108B to be pinched by the lower sheet distributor 110B (in the same fashion as the upper sheet distributor 110A).

Based on an instruction given by the controller 121, the lower sheet distributor 110B holding the 2nd copied sheet rises in the direction indicated by the arrow C to a position in front of the 4th sorter receptacle to discharge the 2nd copied sheet onto the 4th sorter receptacle before returning to the 2nd home position facing the paper discharge receptacle 106B.

Then, in the same manner as the above, the 3rd and 5th copied sheets are delivered onto the 2nd and 3rd sorter receptacles respectively, by the sheet distributor 110A. On the other hand, the 4th copied sheet is transported onto the 5th sorter receptacle by the lower sheet distributor 110B. In short, in sorting the five copied sheets onto the five sorter receptacles respectively, three copied sheets are carried onto the upper three sorter receptacles by the upper sheet distributor 110A, and the rest two are transferred onto the lower two sorter receptacles by the lower sheet distributor 110B. Since the sheet distributors 110A and 110B alternately hold and transfer copied sheets simultaneously, copied sheets discharged at short intervals from a copying machine 102 (for instance, what is called a high-speed copying machine) can be successfully handled by the sheet distributors 110A and 110B.

The aforesaid description how to sort five copied sheets also applies to a case where a large number of copied sheets like 10 or 20 are needed to be sorted at high speed. It is preferable that the numbers of sorter receptacles allocated to the respective distributors 110A and 110B are the same. If the number of sheets to be copied is 10, five sorter receptacles ought to be allocated to each sheet distributor 110A or 110B. If the number of sheets is odd, however, it is impossible to assign the same number of sheet receptacles to each of the sheet distributors 110A and 110B. When N is the total number of sheets to be copied, it is a good policy to allocate P sorter receptacles to the lower sheet distributor 110B where $P=N-N/2$ (round decimals of N/2). Following the above policy, if the number of sheets to be copied is 3, 5, 7 or 9, the number of sorter receptacles assigned to the lower sheet distributor 110B is 1, 2, 3, or 4 respectively.

The aforesaid description has clarified in detail how to sort copied sheets. But, one problem still remains to be answered, that is, how to deal with sheet jamming in the sorter 101 and copied sheets following the jammed one. In an embodiment according to the invention, following measures have been taken to improve the operability:

Various types of jam detection methods may be available. In this embodiment, as shown in FIG. 16, both the receive sheet sensor 125 disposed adjacent to the sheet receive rollers 111 and the aforesaid sheet detect sensor 122 are employed to find jam. That is to say, the controller 121 detects that a copied sheet has been jammed when a leading edge of the copied sheet failed to reach the sheet detect sensor 122 within a certain time after it was detected by the receive sheet sensor 125.

If a copied sheet is jammed in either the sheet transfer means 107A or 107B, the controller 121 switches the transfer path switching claw 112 over to the other transfer means having no jam so that following copied sheets are sent thereto. And the driving roller 123 is rotated clockwise in FIG. 17 with the sheet distribution means (110A or 110B) in the sheet transfer means into which following sheets are being fed fixed to the 1st or 2nd home position respectively.

Once a jam has occurred, the above operation permits following copied sheets to be continuously sent to a sheet transfer means other than that associated with jam and finally to be successively stacked on a sheet discharge receptacle (106A or 106B) in a corresponding sheet transfer means. Therefore, if copying machine and the sorter 101, thus allowing all following copied sheets to be taken out or stacked onto a sheet discharge receptacle (106A or 106B) with no sheets impaired, although sorting is given up. And only work remains to be done for removing the jammed sheet from either the sheet transfer means 107A or 107B in the sorter 101. It is easy to remove a jammed sheet as well as to locate where it is left.

A sheet transfer means is not limited to 107A and 107B as shown in FIG. 16, but any other means can be employed if it can carry sheets onto respective receptacles in the receptacle group A or B. The number of receptacle groups need not necessarily to be two, A and B.

The structure of the aforesaid sorter 101 depicted in FIGS. 16 and 17 facilitates the removal of jammed sheet out of the sorter 101.

The above embodiments exemplify a case shown in FIG. 1, where one central receptacle of a plurality of receptacles 9 is taken as a reference receptacle, a separate case shown in FIG. 12, where two central receptacles are taken as two reference receptacles, and a further separate case shown in FIG. 16 where a top receptacle and a central receptacle are taken two reference receptacles. Positions of reference receptacles, however, are not necessarily limited to those in the above three cases, but, for instance, as shown in FIG. 16, in a case where a plurality of receptacles 105 is divided into a first receptacle group A and a second receptacle group B, essentially central receptacles of respective receptacle groups may be taken as reference receptacles for lift members 113 in sheet dividing means 110A and 110B, thus accelerating sheet sorting in respective receptacle groups A and B.

What is claimed is:

1. A sorter having a bank of receptacles vertically disposed at given intervals to sort sheets discharged from a sheet handling machine onto said receptacles, comprising:

a plurality of lift members disposed close to said bank of receptacles and movable up and down, lift driving means for respectively raising and lowering said respective lift members from a wait position at which sheets are received, sheet pinching means respectively disposed at said respective lift members to momentarily hold a sheet being transferred, sheet discharge means respectively disposed at said respective lift members to discharge sheets toward receptacles, means for discharging sheets from said sheet handling machine so that said discharge sheet is held by said sheet pinching means on one of said lift members positioned at said wait position, means for transporting said one of lift members to a target position while said sheet pinching means holds the sheet, and means for controlling said sheet discharge means to discharge the sheet toward the target receptacle.

2. A sorter as claimed in claim 1, wherein said wait position is common to two lift members neighbored to each other among said plurality of lift members, one of said two lift members is permitted to rise and lower in a range upwards of said wait position, and the other lift member is permitted to rise and lower in a range downwards of said wait position.

3. A sorter as claimed in claim 2, wherein said plurality of lift members is two lift members which are disposed close to the bank of receptacles, and said wait position is located to match an essentially central receptacle among said plurality of receptacles.

4. A sorter as claimed in claim 1, wherein said wait positions are located in correspondence with said each lift members, and further comprising sheet guide means for selectively feeding sheets discharged from said sheet handling machine to one of said wait positions.

5. A sorter as claimed in claim 4, wherein said plurality of lift member is two lift members which are disposed close to the bank of receptacles, and wait positions for said two lift members are located to match two receptacles neighbored to each other at essentially the center of said plurality of receptacles.

6. A sorter as claimed in claim 4, wherein said plurality of lift members is two members which are disposed close to the bank of receptacles, the first wait position for one of said lift members is located to match the highest receptacle among said plurality of receptacles, the second wait position for the other lift member is located to match an essentially central receptacle among said plurality of receptacles, said one of lift members can rise and lower in a range from the first wait position to the second wait position, and said the other lift member can rise and lower in a range downwards of the second wait position.

7. A sorter as claimed in claims 5 or 6, wherein:

said sheet guide means carry sheets discharged from the sheet handling machine alternatively to said first wait position and said second wait position, and said two lift members alternatively sort sheets.

8. A sorter as claimed in claim 6, wherein:

said the other lift member can rise and lower in a range including further from the first wait position to the second wait position, said sheet guide means, carries sheets discharged from said sheet handling machine alternatively to said first wait position and said second wait position, and said respective first and second lift members alternatively sort sheets onto the receptacles being in a range between the first wait position and the second wait position.

9. A sorter as claimed in claim 8, wherein, when the total number of sheets to be sorted is N, either of said two lift members sorts P sheets, said P is a number expressed by $P=N-N/2$ where decimals of $N/2$ are rounded up.

10. A sorter as claimed in claim 4 further comprising:

means for controlling said sheet guide means, when a sheet fed through said one of wait positions is jammed, to change a feeding direction of sheets discharged successively from said sheet handling machine from said one of wait positions to another one of wait positions, means for controlling said lift driving means to locate one of lift members at said another one of wait positions, and said means for controlling said sheet discharge means discharging sheets fed by said sheet guide means onto a receptacle corresponding to said another one of wait positions.

11. A sorter as claimed in claim 4, wherein two lift members are disposed close to bank of receptacles, said plurality of receptacles are divided into two groups, in one of which sheets are sorted by one of said lift members and in another of which sheets are sorted by the other lift member, said wait positions are respectively located to match an essentially central receptacle in each of said two receptacle groups.

12. A sorter having a bank of receptacles vertically disposed at given intervals to sort sheets discharged from a sheet handling machine onto said receptacles, comprising:

a plurality of lift members disposed close to said bank of receptacles and movable up and down, lift driving means for respectively raising and lowering said respective lift members from a wait position at which sheets are received, sheet pinching means respectively disposed at said respective lift members to momentarily hold a sheet being transferred, sheet discharge means respectively disposed at said respective lift members to discharge sheets toward receptacles, means for discharging sheets from said sheet handling machine so that said discharged sheet is held by said sheet pinching means on one of said lift member positioned at said wait position, means for transporting said one of lift members to a target position while said sheet pinching means holds the sheet, means for controlling said sheet discharge means to discharge the sheet toward the target receptacle, and means for controlling said lift drive means to move one of said lift members toward the wait position while another one of said lift members moves to the target receptacle.

* * * * *